US012752158B2

(12) United States Patent
Puumalainen et al.

(10) Patent No.: US 12,752,158 B2
(45) Date of Patent: Oct. 6, 2026

(54) GOLF SIMULATOR

(71) Applicant: Daddy Sports Inc., Irvine, CA (US)

(72) Inventors: Daniel Puumalainen, Santa Monica, CA (US); Eric Cherny, Campbell, CA (US)

(73) Assignee: Daddy Sports Inc., Irvine, CA (US)

( * ) Notice: Subject to any disclaimer, the term of this patent is extended or adjusted under 35 U.S.C. 154(b) by 98 days.

(21) Appl. No.: 18/882,701

(22) Filed: Sep. 11, 2024

(65) Prior Publication Data

US 2025/0082996 A1 Mar. 13, 2025

Related U.S. Application Data

(60) Provisional application No. 63/537,698, filed on Sep. 11, 2023.

(51) Int. Cl.

| | |
|---|---|
| ***A63B 60/46*** | (2015.01) |
| ***A63B 24/00*** | (2006.01) |
| ***A63B 69/00*** | (2006.01) |

(52) U.S. Cl.
CPC .... *A63B 24/0006* (2013.01); *A63B 2220/806* (2013.01)

(58) Field of Classification Search
CPC ..... A63B 24/0006; A63B 2220/806; G06V 40/23; G09B 19/0038
See application file for complete search history.

(56) References Cited

U.S. PATENT DOCUMENTS 12,053,671 B1 * 8/2024 Clark ..... A63B 69/0002

* cited by examiner

*Primary Examiner* — Howard D Brown, Jr.
(74) *Attorney, Agent, or Firm* — Blank Rome LLP

(57) ABSTRACT

A method of predicting ball flight of a golf ball includes analyzing image data of a divot region including a ball location marker resulting from a swing of a golf club by a subject. A prediction of ball flight of a golf ball if positioned on the ball location marker during the swing is generated based at least partly on the analysis of the image data of the divot region. The prediction may be generated without analysis of a ball on the ball location marker being struck or present.

16 Claims, 10 Drawing Sheets

GOLF SIMULATOR

CROSS-REFERENCE TO RELATED APPLICATIONS

The present application claims the benefit of the priority data of U.S. Provisional Patent Application No. 63/537,698, filed Sep. 11, 2023, the contents of which are hereby incorporated herein by reference.

TECHNICAL FIELD

The present disclosure is directed to golf simulation systems and methods that analyze image data of a golf swing to predict a ball flight. More specifically, the present disclosure is directed to golf simulation systems and methods that analyze image data of one or more of a divot region, club region, or body posture region to predict ball flight resulting from a golf swing without analysis of a ball struck by the swing if present.

BACKGROUND

Golf simulators use optical analysis of an initial ball flight of a golf ball after being struck by a golf club to predict complete ball flight. The initial ball flight is typically captured by one or more cameras, radar, or lasers. The predicted ball flight may be depicted on a screen to simulate the ball flight. Various parameters of the ball flight may also be displayed. This technology and the systems that incorporate them are very expensive, resulting in the systems being out of reach of most consumers. These systems also require users to hit an actual golf ball in order to generate a predicted ball flight resulting from a swing. This limits the use of the systems to hitting bays and outdoor ranges. Thus, users with limited space and equipment are unable to take advantage of the functionalities of these systems. What is needed are improved golf simulator systems that are accessible to the common consumer to provide entertainment and helpful information and instruction even in the absence of a golf ball.

SUMMARY

In one aspect, a system is configured to implement an image-based or convolutional model configured to extract information from a divot. This information may comprise divot variables that the system utilizes together with body posture data, club identification data, or both to predict a ball flight of a simulated ball from a hitting surface. For example, the system may be configured to encode a divot in image data captured of a swing and use it inside of a model in order to predict or help predict or generate features for flight attributes.

In the above or another aspect, the system is configured to employ body posture models such as image pose estimation, human tracking, video pose estimation, or 3D uplifting models for depth estimation to generate a plurality of body posture variables from image data captured of a swing. The system may be further configured to perform golf club identification and features associated with it to, for example, generate club variables such as clubhead location, club path or direction, club face angle, and club speed for image data. The system may be further configured to perform hitting surface identification from the image data including divot analysis to generate divot variables. Using the above variables, the system may be configured to generate a predicted ball flight of a simulated ball. This process may be performed despite the absence of a ball. The predicted ball flight may include predicted distance shot variables as well as non-distance shot variables, such as those described herein.

Further to any of the above aspects, the hitting surface may include a mat and the system may be configured to analyze the mat image captured during the swing to identify motion, such as momentary distortions, shrinkage, or compression or movement of the position of the mat on a ground surface as a result of the swing. In such an example, the system may be configured to utilize the motion data in modeling to predict shot variables use to generate predicted flight path.

In any of the above examples or another example, the system is configured to further utilize historical user data, such as the user height, skill level, target distance, accuracy of an N number of previous shots to predict shot variables.

In any of the above aspects, predicted flight paths may include coordinates depicting the flight path or may be transformed into coordinates for rendering within a simulated shot environment, such as an animated environment depicting a golf course, range, target objects, or otherwise. The model outputs, such as shot variables, may be used to provide info to the user and for generation graphics consistent with the outputs. For example, a display of shot variables, which may include non-distance variables, distance variables, or combinations thereof may be displayed or available for selective display via user interaction with the user interface. In one example, available variables for display may include divot variables, body posture variables, or both. Body posture variables, for instance, may be additionally or alternatively available for view via a graphic rendering of the body posture. The values for the body posture variables may be incorporated in the graphic rendering or presented separately.

In one aspect, a method of predicting ball flight of a golf ball includes analyzing image data of a divot region resulting from a swing of a golf club by a subject, the divot region including a ball location marker and a divot created by a golf club during a golf swing. The method may further include generating ball flight data comprising predicting, based at least partly on the analysis of the image data of the divot region, ball flight of a golf ball if positioned on the ball location marker during the swing without analysis of actual movement of the golf ball, if present.

In one example, the method further includes analyzing image data of a body posture region of the subject during the golf swing and the predicting is based at least partly on the analysis of the image data of the body posture region. In one example, image data may be analyzed to generate a dynamic stick figure representative of the body posture of the subject during the swing. The analysis may identify dynamic movement of joints (the stick figure may include various joints The body posture region may include hands or wrists of the subject. The analysis of the hands or wrists may include determining clubhead speed of the golf club swung by the subject.

In the above or another example, the method further includes analyzing image data of a clubhead region during the golf swing and the predicting is based at least partly on the analysis of the image data of the clubhead region. The analysis of the clubhead region may include determining clubhead speed of the golf club swung by the subject.

In any of the above or another example, the method includes collecting the image data with a camera.

In any of the above or another example, the method includes generating a graphical representation of the ball flight data.

In any of the above or another example, the method includes plotting the ball flight data within an animated game environment.

In any of the above or another example, at least a portion of the method is performed with a user device comprising a smart phone, tablet, laptop, or dedicated device executing a mobile application.

In any of the above or another example, the user device includes a camera, and the image data of the swing is captured in video by the camera.

In any of the above or another example, the analysis of the image data of the divot region is performed by a computer vision model configured to track divot impact on a ground surface.

In any of the above or another example, the analysis of the image data of the body posture region is performed by a computer vision model configured to track body posture during the swing.

In any of the above or another example, the analysis of the image data of the body posture region tracks body posture from the beginning to the end of the swing.

In any of the above or another example, the analysis of the image data of the clubhead region is performed by a computer vision model configured to track a clubhead during the swing.

In any of the above or another example, the ball flight data comprises shot variable predictions of ball flight apex, carry distance, carry deviation from a centerline, total distance from the centerline, total deviation from centerline, or combination thereof.

In any of the above or another example, the method includes plotting the ball flight data into a game to act as a golf simulator.

The image data may include an image frame of the divot region, multiple image frames of a divot region over time, e.g., sequential image frames captured by video, that are captured prior to and after passage of the club through an impact zone including the divot region. In one example, the image data of the divot region includes images captured during passage of the club through the impact zone, which may be include, be in addition to, or in alternative to images captured prior to passage of the clubhead, after passage of the clubhead, or both. The image data corresponding to the clubhead region, body posture region, or both may similarly include multiple image frames of such regions captured during the swing (e.g., one or more of set-up/address, takeaway, backswing, top of backswing, transition, downswing, through the impact zone, or follow through). In some embodiments, the image data with respect to one or more regions, when included, may be captured from multiple angles.

In one aspect, a method of predicting ball flight of a golf ball includes analyzing image data of at least one of a clubhead region of a golf club or a body posture region of a subject swinging the golf club during a golf swing a divot region resulting from a swing of a golf club by a subject, the divot region including a ball location marker. The method further includes generating predicted ball flight data comprising predicting, based at least partly on the analysis of the image data of the at least one of the clubhead region or body posture region and the divot region, ball flight of a golf ball if positioned on the ball location marker during the swing.

In one example, the ball flight is not predicted using analysis of actual movement of the golf ball, if present.

In the above or another example, the method further includes plotting the ball flight data in an animated game.

In some aspects, the system and methods described herein may be configured to generate ball flight predictions in one or more large models. For instance, the system may execute ball flight predictions in a large model architecture, which may include the above image data processing, with multi-modal input vectors coming in at different starting points. The model may include a convolutional neural network (CNN). For instance, CNN layers may start in the beginning and perform pixel embeddings and feature extractions until a later layer is hit ("post-CNN") and then prepend to this feature vector another vector of inputs. Divot variables and one or both of posture variables or club variables may be used to generate predicted shot variables which may include utilizing the divot variables and one or both of posture variables or club variables as inputs in model ensembles to generate predicted ball flight.

In another aspect, a golf simulator application is executed by a processor to perform the operations of any portion of the above aspects.

In yet another aspect, a golf simulator system includes a processor and memory that stores instructions that when executed by the processor causes the system to perform any of the operations of any of the above aspects.

In still another aspect, a computer readable medium that when executed by a processor performs any of the operations of any of the above aspects.

BRIEF DESCRIPTION OF THE DRAWINGS

Novel features of the present invention are set forth with particularity in the appended claims. However, the various embodiments described herein, both as to organization and manner of operation, may be best understood by reference to the following description, taken in conjunction with the accompanying drawings in which:

DESCRIPTION

Figure 1:
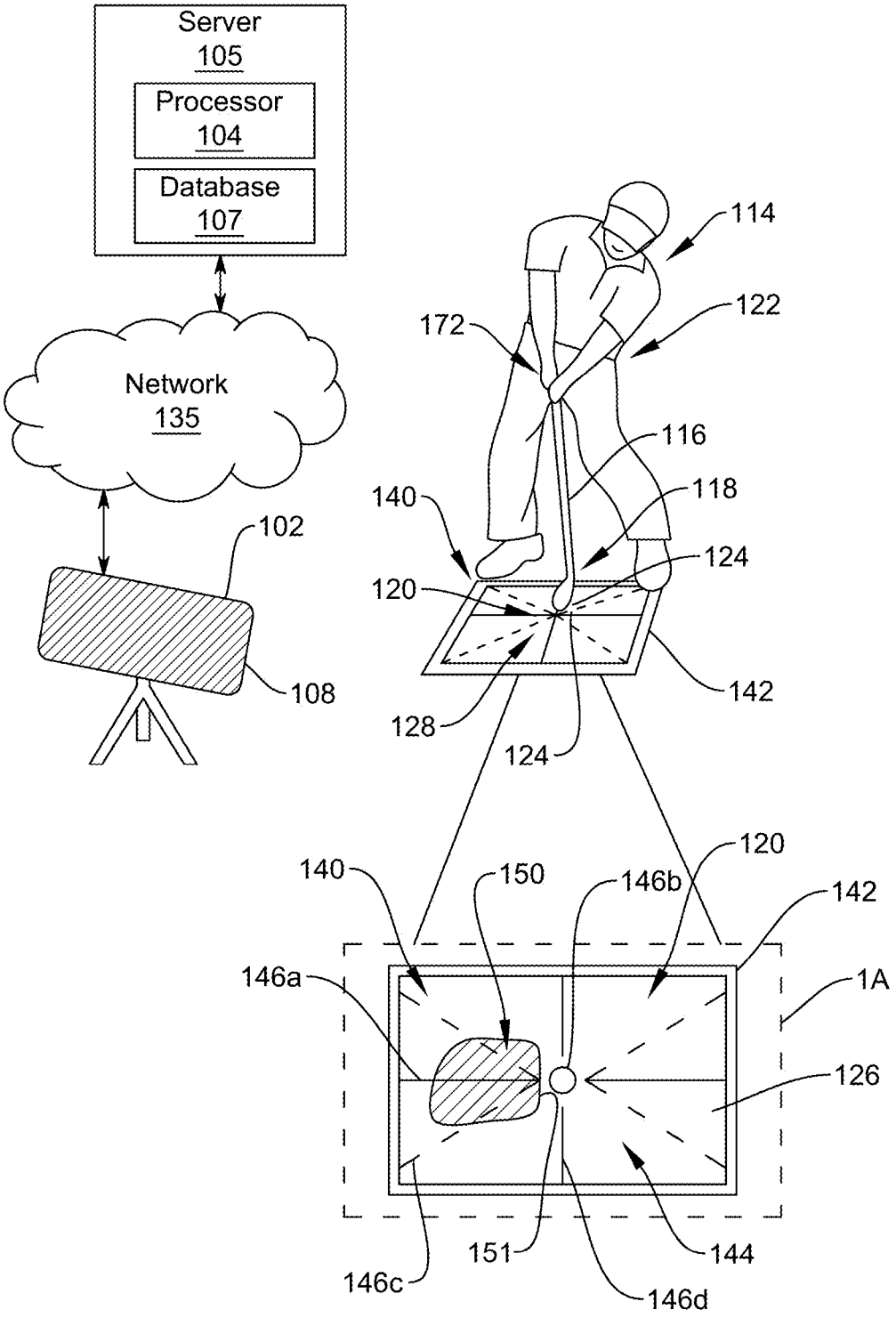
FIG. 1 schematically illustrates components of a system according to various embodiments described herein.

The present description describes various embodiments of a system and method of generating predicted ball flight of a golf ball when struck by a golf club during a swing. The system may comprise an imaging device to collect image data of the swing or receive the image data from an imaging device. The imaging device may comprise a camera configured to capture images, such as sequential image frames, e.g., video images. The predicted ball flight may be output in a golf game or golf simulator environment. For example, predicted ball flight data may be plotted within a game or golf simulator environment that graphically depicts the predicted ball flight. The game or golf simulator environment graphically depict the predicted ball flight within a 3D rendering computer animation.

In contrast to current golf simulator technology, the system may generate ball flight predictions without a golf club contacting a ball. That is, a user may swing a golf club at a ball location that does not include a ball wherein image data of the swing is captured for analysis to generate predictions with respect to ball flight of a ball had the ball been located at the ball location. The ball location may be a predetermined area or may be identified to the system via markers present in the image data.

The system may be configured to analyze image data collected from one or more regions of a scene wherein the subject swings the golf club for analysis by the system. In various embodiments, regions may be selected from a clubhead region, divot region, body posture region, or combination thereof. In some configurations including analysis of multiple regions, two or more regions may be captured in the same images, separately, or a combination thereof. In one example, when the image data comprises separate images of two or more regions, the image data may be time stamped or otherwise sequenced in time for analysis by the system.

The clubhead region may include the clubhead of the golf club being swung by the subject. In one embodiment, the system is configured to analyze the image data of the clubhead to determine a clubhead speed. The system may, for example, analyze clubhead speed through an impact zone to measure clubhead speed. In this or another example, the system may analyze image data of the clubhead to measure clubhead speed during other portions of the swing or to predict clubhead speed through the impact zone. The impact zone may be an actual impact zone including a golf ball or may be an impact zone with a simulated or virtual golf ball, e.g., a golf ball marker or other ball indicator that the subject swings the golf club through as if an actual golf ball were present. Additionally or alternatively, in some embodiments, the system may track face position at one or more points of the swing. In one example, face position may include a face angle. As described in more detail below, the system may utilize clubhead tracking data derived from analysis of the clubhead image data and utilize the tracking data to generate ball flight data that includes predicted ball flight, which may include various ball flight variables. In one example, the system may integrate the clubhead tracking data, ball flight data, or both in a computer animation of the swing, ball flight, bounce, rollout, resting location relative to a simulated golf hole or target, or combination thereof. In one embodiment, the system may generate an animation representative of the subject's body posture during a swing. The animation may include the golf shaft and/or clubhead relative to the body movement during a golf swing. The animation may include or be developed on top of a dynamic stick figure generated by the system from analysis of the image data.

The divot region may correspond to a location the clubhead contacts a ground surface during the golf swing. In some embodiments, the divot region includes a divot indicating area configured to provide contrast with respect to the surrounding area for analysis of the divot by the system. For example, the divot indicating area may include a grass turf whereby clubhead interaction with the turf may be detected in the image data via analysis of the turf before and after clubhead interaction. Divot indicating areas may also be provided on a golf mat. For example, a golf mat may include a material that when contacted indicates location of clubhead interaction during the golf swing. The material may depict clubhead interaction via visual contrast, e.g., in color (which may include shade or tone), finish, reflectivity, size, shape, material, texture, physical contour, or the like. For instance, the golf mat may include fibers that bend, pivot, or lay when contacted by a clubhead to indicate a divot location. The divot may be indicated by a contrast with pre-contact color, texture, physical contour, or combination thereof. The divot may be indicated by contrast with surrounding portions of the divot indicating area. In another example, the divot indicating area comprises pivotable objects coupled to the golf mat that pivot in response to contact with a clubhead moving over the surface of the mat. Various pivotable objects may be used, e.g., sequins, blocks, extensions, projections, or the like. After interaction has been captured in the image data, the objects may or may be pivoted back to their pre-interaction position or orientation. In some examples, a golf mat comprises objects that bend, toggle, or otherwise move in response to clubhead contact. For instance, the golf mat may include wires, sequins, blocks, extensions, or projections. The objects may be bendable, toggleable, or otherwise movable back into a pre-interaction position by manual interaction or by material properties. For example, the objects may be resilient such that they may be elastically deformed and then return to pre-interaction condition. In some embodiments, the return is rapid such that the image data captures momentary interaction in less than a second for analysis while in other embodiments the results of the interaction may be visualized for multiple seconds. The objects may have any suitable shape, such as square, triangle, polygon, disc, oblong, or freeform. The objects may have different colored surfaces that contrast with those of the surrounding when contacted, e.g., when bent, toggled, pivoted, disturbed, or otherwise moved.

Materials or objects used to provide contrast as to depict contact may include layers to indicate depth or degree of contact. For example, color or other visual indicators may differ between layers such that contact that reaches a second layer contrasts with contact that reaches only a first layer. Materials or objects used to provide contrast to depict contact may include a upper portion having a different color or other visual indicator that differs from that of a lower portion to indicate depth or degree of contact. For example, contact that bends or reorients material or objects and reveals a lower portion may be distinguishable from contact that bends or reorients material or objects and reveals only an upper portion. In one embodiment, materials or objects include thermochromic material that provide a detectable change in color caused by heat generated from clubhead contact. As more heat is generated in locations of more contact, the degree of detectable change may be used to provide a divot fingerprint for analysis. In any of the above or another embodiment, the imaging device may include an infrared camera to detect a heat signature pattern between a pre-contact mat surface and a post-contact mat surface corresponding to a divot for analysis.

In some embodiments, the divot indicating area or location adjacent thereto includes one or more markers. The markers may be used by the system as calibration markers during analysis of the image data. For example, the markers may comprise a line indicating a direction of intended ball flight from which the system uses to orientate club parameters and/or swing parameters for generating predicted ball flight. The line indicating direction of intended ball flight may otherwise be a target line corresponding to a target the subject is to locate the golf ball with the swing. Markers may also include a ball location marker that the system uses as a location of a ball struck by the clubhead during the swing from which predictions may be made. Markers may include visible or detectable contrast between the marker and surrounding area. Markers may include visible or detectable differences in color, shade, tone, finish, reflectivity, size, shape, or the like relative to adjacent or surrounding materials or objects. In some embodiments, markers that extend within a divot indicating area may remain visible or detectable even when within a divot. For example, objects or materials on which the marker lies may provide visible or detectable contrast with adjacent or surrounding objects or materials whether in a pre-contact or post-contact state. For instance, pivotable objects or materials on which a marker lies may be a different color than adjacent or surrounding objects or materials whether either are in a pre-contact or post-contact state.

In one embodiment, the divot indicating area is a digital plane established by the system wherein the system tracks the clubhead with respect to the digital plane to generate a representative divot corresponding to the clubhead's interaction with the digital plane. In one embodiment, a digital plane may be established above a ground surface, e.g., above a ground surface located behind a ball striking location for generating predicted outputs with respect to image data of a user swinging a driver. Those having skill in the art will appreciate that in some embodiments the digital plane is not limited to a plane and may be configured to be representative of any contoured ground surface.

The system may utilize tracking data derived from analysis of the divot region image data to generate predicted ball flight data. In one example, the system may utilize the ball flight data derived from analysis of the divot region image data to generate a computer animation of the swing, ball flight, or combination thereof.

The system may analyze one or more of the divot shape, direction, starting angle, path length, or path relative to the target line or ball indicator. The system may analyze depth or degree of contrast within the divot. In one example, a divot that begins behind a ball location marker, may indicate a fat shot. A fat shot may decelerate the clubhead through the impact zone, present a lower loft at contact, twist the clubhead, among other things. This may impact ball flight variables predicted by the system such as reduced distance, lower apex, off-centerline, or combination thereof. As another example, a divot that starts square to the target and extends along an outside to inside path may predict a ball flight that moves right of the divot path. As another example, a divot that starts square to the target and extends along an inside to outside path may predict a ball flight that moves left of the divot path. As another example, a divot that is outside the ball indicator may predict a shank. As another example, a divot that starts with an angle open to the direction of divot path may predict a ball flight that moves right of the direction of the divot path. Conversely, a divot that starts with an angle closed to the direction of the divot path may predict a ball flight that moves right of the direction of the divot path. A divot that starts square to the direction of the divot path may predict a straight shot relative to the direction of the divot path. As noted above, the system may analyze multiple aspects of a divot to predict a flight path. The system may also analyze image data from other regions in combination with analysis of the image data of the divot region to predict the flight path.

The body posture region may include various aspects of the subject at one or more portions of the swing. Aspects may include one or more of hip position, spine angle, lead arm position, trail arm position, forearm rotation, wrist angle, hand position, body sway, shoulder angle, should turn, knee position, ankle position, forward lean, feet spacing, feet angle, body alignment, or chest position at one or more stages of the swing. In some embodiments, one or more aspects of body posture may be tracked from takeaway to follow through. In these or other embodiments, one or more aspects of body posture may be tracked during one or more portions of the swing, such as during the setup, takeaway, takeaway to club at waist level in backswing, club at waist level to the top of the backswing, at the top of the back to club at waist level in downswing, club at waist level in the downswing to impact zone, impact zone to club at waist level in follow through, or club at waist level in follow through to completion of follow through. In one embodiment, one or more aspects of body posture selected from wrist angle, hand position, or both may be tracked during one or more portions of the swing from setup through the follow through. In one example, they system may track wrist angle, hand position, or both for analysis to derive data with respect to the clubhead, such as a face position, face orientation, face angle, clubhead speed, or combination thereof.

As described in more detail below, image data captured of the body posture region, divot region, clubhead region, or combination thereof may be analyzed to generate a dynamic stick figure representation of the swing. Analysis of the image data and/or dynamic stick figure extrapolated therefrom may include measurement of locations of body portions, club shaft, and/or clubhead during one or more portions of the swing. In one embodiment, analysis of the image data and/or dynamic stick figure extrapolated therefrom may include measurement of body angles, relative body angles, body angles relative to the golf shaft and/or clubhead, which may include angles thereof. For instance, spine angle relative to one or more of shoulder angle, hip direction, torso direction, hip location, leg position, or shaft angle may be measured. Indeed, the system may be configured to measure any desired relative location and/or angle for purposes of predicting ball flight variables, club variables, and/or swing variables.

The image data may include an image frame of the divot region, multiple image frames of a divot region over time, e.g., sequential image frames captured by video, that are captured prior to and after passage of the club through an impact zone including the divot region. In one example, the image data of the divot region includes images captured during passage of the club through the impact zone, which may be include, be in addition to, or in alternative to images captured prior to passage of the clubhead, after passage of the clubhead, or both. The image data corresponding to the clubhead region, body posture region, or both may similarly include multiple image frames of such regions captured during the swing (e.g., one or more of set-up/address, takeaway, backswing, top of backswing, transition, downswing, through the impact zone, or follow-through).

The imaging device may be positioned to capture the image data of one or more regions of a scene wherein a subject swings the golf club for analysis by the system. In one example, the imaging device may be positioned in front of the subject to capture image data of a swing. In this or another example, the imaging device may be positioned to the side of the subject, behind the subject, or above the subject. In some embodiments, multiple imaging devices may be used to capture image data from multiple perspectives. The system may collate and sequence the multiple perspectives for analysis.

The image data may be analyzed by the system, e.g., via a processor. In some embodiments, the analysis comprises machine learning, such as artificial intelligence. In further embodiments, the analysis utilizes artificial intelligence comprising computer vision. The system may comprise or incorporate models trained on image data of actual swings and resulting ball flight variables corresponding to relevant regions the system is to analyze to generate predictions described herein, such as predictions corresponding to ball flight, which may include ground interaction. In one embodiment, the system includes a database including one or more computer vision models accessible by the processor. The computer vision models may be static or dynamic. For example, the system may be configured to update the computer vision models periodically or continuously. Updates may be the result of additional or enhanced tuning or learning, e.g., with training data.

In one example, image data may be analyzed to generate a dynamic stick figure representative of the body posture of the subject during the swing. The stick figure may be used by the system for further analysis. For instance, algorithms and/or modeling may be applied to dynamic stick figure extrapolated from image analysis. The stick figure may be dynamic about one or more joints or body regions selected from feet, ankles, lower leges, knees, thighs, hips, pelvis, torso, spine, shoulders, upper arms, elbows, forearms, wrists, hands, fingers, neck, or head. In one example, artificial intelligence may be trained with dynamic stick figure analysis, which may include dynamic stick figure animation, representative of a body posture during swings and the resulting ball flight data, e.g., ball flight variables. In another or further examples, the artificial intelligence may be trained with additional variables such as club variables corresponding to the swings. For instance, the system may analyze the image data and extrapolate movement, such as relative movement between portions of the subject's body posture and/or club, and generate a dynamic stick figure representation. In one embodiment, the analysis of body posture of the subject together with the golf shaft, which may in some examples also include the clubhead, during the swing may be extrapolated to generate the dynamic stick figure. The artificial intelligence may be configured to analyze the subject's body angles alone or together with the club shaft, clubhead, or both during a swing. The position of the golf shaft relative to the subject during the golf swing may be captured in the body posture region or may be inferred by the system from analysis of the location and/or orientation of the hands and/or wrists. In these or another example, the position of the golf shaft relative to the subject may be determined from the analysis of the clubhead region, either directly or indirectly by the orientation of the clubhead during the swing. As noted elsewhere herein, the image data may be time stamped such that the system may synchronize image data between regions. As also described elsewhere herein, in some embodiments, multiple regions may be captured in the same image frames. In one embodiments, the body posture region may include the golf shaft.

In some embodiments, the system may include an application or may be configured to receive image data from an application for processing via image analysis. For example, an application may integrate with the operations of a smartphone camera or receive image data captured by the smartphone camera. In some embodiments, the application may run on the smartphone, laptop, desktop, or other digital computing device, which may include a dedicated device, that interfaces with an imaging device. The system processor may analyze the image data as described herein. In one embodiment, the application or user device executing the application may transmit or otherwise provide the image data to the processor for analysis. The processor may be local or remote. In one example, the image data is transmitted to the cloud for processing. For instance, the image data may be transmitted to a server comprising the processor, wherein the processor analyzes the image data, e.g., by applying one or more computer vision models, and generates ball flight data.

This ball flight data may include or be utilized to output predicted ball flight variables, generate a predicted ball flight, integrate a predicted ball flight into a simulation, or combination thereof. It will be appreciated that the ball flight variables or associated data may be transmitted to a user interface for integration in the simulation or the simulation may be transmitted to the user interface. The user interface may include a graphical display, which may be integrated with or separate from the user device executing the application. The ball flight variables may be integrated, e.g., plotted, in a golf game to provide a golf simulator. The simulation, e.g., golf game, may be executed on the user device. As introduced above, the flight variables may be rendered in a computer animation, table, numerical or other graphical representations, or combination thereof. In one embodiment, the golf game comprises a 3D game. In various embodiments, the user interface may include a shot indicator wherein a user may interact with the indicator to start a time period for which the system is to collect shot data for a next shot. For example, the shot indicator may include a soft button or otherwise that a user taps or clicks to initiate a time period for the next shot. In this or another embodiment, the system is configured to cause the application to continuously or periodically collect image data for detection of a user swing. In one example, the image captured image data may be retained for a period of time, such as 10 to 15 seconds, and if a swing is not detected, the image data is deleted or removed from memory, such as cache, such that captured data for the period of time is continuously retained as the first in image data is deleted or removed, which may be continuous or at predetermined intervals. For instance, if 10 seconds of image data is to be retained and maintained at one second intervals, if no swing is detected after 11 seconds, the oldest one second of image data is deleted or removed from memory. This repeats until a swing is detected. When a swing is detected, the image data captured prior to the swing detection that remains in memory may be analyzed for relevant information, such as address determination.

As introduced above, predicted ball flight data derived from the analysis of the image data may be generated for output in, or generated in, a graphical representation. The graphical representation may include numerical graphics, tables, computer animated depictions of the data, or both. The graphical representation may be implemented in various applications such as for education or instruction purposes, for depiction in a golf simulator, or combination thereof. A golf simulator application may comprise a computer animated depiction of a predicted golf ball flight path. Various predicted variables of the ball flight path and/or predicted ball interactions at or following predicted impact may be output in numerical format, tables, computer animated depictions, or combination thereof. For example, ball flight variables such as apex, carry distance, total distance, carry deviation from a target center line, total deviation from a target centerline, or combination thereof may be output in numerical format, tables, computer animated depictions, or combination thereof. Additional variables generated from the tracking data may include, for example, one or more of club variables such as clubhead speed, tempo, attack angle, face angle, dynamic lie, or dynamic loft, one or more ball flight variables such as one or more of exit velocity, trajectory, or spin profile, or combination thereof. Swing variables may also be generated. Swing variables may include body position during a swing. Body position may include location of portions of the subject's body, measurements of movements of the portions of the subject's body, relative distance and/or movement between the portions of the subject's body, angles created between the portions of the subject's body, or combination thereof. In one embodiment, swing variables include club variables such as shaft position, angle, speed, or combination thereof. Swing variables may also include club variables such as club face direction, club face angle, angle of attack, dynamic loft, and the like. The swing variables may include such club variables relative to position, location, movement, and/or angle of one or more portions of the subject's body. In some embodiments, swing variables may incorporate or be utilized to indirectly measure club variables, The computer animated depictions may also include a depiction of a golf hole or other shot target. In a further example, the golf simulator includes a computer animated depiction of predicted ball flight, landing, roll out, or combination thereof. In this or another example, the golf simulator includes a selection of interactive holes, courses, or golf challenges that a user may select.

As introduced above, the system may be configured to output the tracking analysis in a graphical format to provide a user with information regarding a tracked swing. In one embodiment, the tracking data output includes a computer animation of the swing incorporating swing variables derived from the analysis of the image data. The computer animation may be included within the operation of the golf simulator or in a different graphical representation.

In one embodiment, system employs a computer vision model for body posture region and clubhead region tracking of the image data, such as video. In one example, the computer vision model may utilize a computer vision framework developer, such as MediaPipe. A pose estimation model may be employed to derive hand coordinates of the subject, which may be tracked throughout the swing, or portions thereof. The estimation model may additionally or alternatively derive coordinates with respect to the portions of the subject's body during the swing for analysis, which in some embodiments may include generate a dynamic stick figure representative of the subject's body during the swing. The model may be used to determine data points comprising variables of ball flight, swing, club, or combination thereof, such as one or more of club speed, attack angle, club path, club face, face to path, ball speed, launch angle, launch direction, backspin, sidespin, spin rate, spin axis, apex height, carry distance, carry deviation angle, carry deviation distance, total distance, total deviation angle, total deviation distance, or ball flight tracer shape. As described in more detail elsewhere herein, the system may utilize analysis of multiple regions to measure and/or predict ball flight variables, swing variables, club variables, or combination thereof. For instance, club speed may be determined from tracking clubhead or a combination of two or more of hands, club shaft, or clubhead. As introduced above, the system may utilize artificial intelligence. In one embodiment, the system employs artificial intelligence modeling to predict various data points of the variables. For example, a ground truth data set of hundreds to thousands of swings may be established. This may include, inputting learning sets of swing images including various known variables generally relating to ball flight. For instance, swings may be captured using cameras from multiple angles. In a further example, corresponding ball flights may be captured using ball tracking technology such as high fidelity lidar sensors. Distribution of data relating swing variables, e.g., posture and/or divots, club variables, or any other variable to their corresponding ball flight variables may be created. The model may then be utilized to predict ball flight variables from image data wherein the ball is not present. The model may be further fine-tuned to improve its predictive accuracy. In operation, the data points of the variables may be integrated and rendered into a graphical representation of the predicted ball flight represented in the data points. For example, the data points may be input into a game engine, such as within a Unity engine, to display the predicted ball flight. The game engine may include a 3D graphics engine.

In some embodiments, gradient boosting may be employed that takes the data points, or a relevant portion of the data points, and breaks them down into a category or shot type, such as a low slice, to thereby limit the number of basic flight paths or shapes output to a predetermined number of shot types. For example, the system may analyze the image data to measure a set of variables and then correlate the variables into a predefined category, such as a shot type. The categories may provide a limited set of shot types the system predicts as ball flight outputs. The ball flight outputs may include a graphical output in text, animation, or as otherwise described herein. For example, the system may include a gradient boost tree model or similar configured to classify shot variables into predefined shot types. The predefined shot types may be associated with particular variables and values, e.g., range of values. The assigned shot type may then be output for rendering as an animated trace of the shot on a graphical display. As the number of shot types to be output is limited and may be based on a preestablished shape, categorization may be used to reduce processing load, such as the processing load of a 3D graphics engine configured to generate animated depictions of shots, e.g., including a shot trace. Example shot type categories may include hook, pull, pure, push, fade, slice, pull-hook, and push-slice. In some embodiments, a plurality of shot type categories may include subcategory components that modify a base shot type. For example, the set of variables may include variables indicative of a ball flight height, such as one or more of face angle, club path, face to path, attack angle, dynamic loft, one or more body posture variables, or combination thereof. In one embodiment, each category includes a shot type and a height, e.g., low, medium, high. Thus, the system may include 27 categories defined by a shot type component selected from hook, pull, pure, push, fade, slice, pull-hook, and push-slice and a height component selected from low, medium, and high. The number of categories, shot types, variables used, and subcategories may be modified, increased, or decreased. Additionally or alternatively, in some embodiments, the system may be configured to further modify a ball flight trace corresponding to a predefined category assigned to a shot with other predicted ball flight data derived from the measured variables such as distance, height, or both. For instance, variable values may be used by the system to further modify the shot type category assigned to the shot to modify the ball flight output.

FIG. 1 illustrates an example embodiment of the system 100 according to various embodiments. The system 100 may be configured to generate predicted ball flight data from image data collected from a golf swing. For example, a camera 102 may be positioned to capture images of the swing, such as sequential image frames, e.g., video images. The image data may be analyzed by a processor 104 that executes one or more models to generate tracking data with respect to one or more regions which may include or be utilized to generate predicted ball flight data. This ball flight data may then be output for consumption in one or more formats, such as in a graphical display 106 (see FIG. 3) of a user device 108. In the illustrated embodiment, the camera 102 is integrated with a user device 108. The user device 108 may comprise or access memory storing instructions and a processor to execute the instructions to perform operations of the user device 108. The operations may include processing and/or transmitting the image data through communications network 135 to processor 104, which may include a server 105, for analysis. While the processor 104 is illustrated as being remote, in other embodiments, the processor 104 may be local, which may include being embodied in the operations of the user device 108, e.g., the user device 108 may include processor 104. In some embodiments, the operations of the user device 108 may be instructed by an application executed by the user device 108. In the illustrated embodiment, the user device 108 comprises a smartphone. Other user devices 108 may be used, such as tablets, laptops, desktops, dedicated devices, or other suitable user device 108 for executing the operations. Also in the illustrated embodiment, the user device 108 comprises the graphical display 106. However, in some embodiments, the user device 108 and graphical display 106 may be separate. For example, the graphical display 106 may comprise a television, monitor, projector, or the like configured to output a display provided to it by the user device 108, server 105, or both. The display may include a golf game and/or golf simulation including graphics, such as computer animation, representative of the ball flight data. The display may also include representations of a golf hole, course, target, or the like. In various embodiments, the system 100 may generate ball flight predictions without a clubhead 118 tracked in the image data ever contacting a ball during the swing. That is, a subject 114 may swing a golf club 116 at a ball location that does not include a ball wherein the image data of the swing is captured for analysis to generate predictions with respect to ball flight of a ball had the ball been located at the ball location. Thus, unlike current golf simulators, the system 100 may be used with without a ball. Indeed, in various embodiments, the system 100 does not utilize ball tracking to generate ball flight predictions.

As described above, the system 100 may be configured to analyze image data collected from one or more locations regions of a scene wherein the subject 114 swings a golf club 116 for analysis by the system 100. Example regions may be selected from a clubhead region 118, divot region 120, body posture region 122 of the subject 114, or combination thereof.

The divot region 120 correspond to a location the clubhead 124 contacts a ground surface 126 through an impact zone 128. The impact zone 128 may refer to an area along the ground surface 126 where actual or simulated ball impact is intended and may correspond to a bottom portion 130 of a swing arc 132 between a top of a backswing 134 and a follow through 136 (see FIG. 2). The divot region 120 includes a divot indicating area 140 as most clearly shown in the isolated enlarged overhead view of window 1A. The divot indicating region is configured to provide contrast with respect to the surrounding area. In the illustrated embodiment, the divot indicating area 140 comprises a golf mat 142 having sequins pivotably attached to a mat surface 144, as is known in the art. The sequins include contrasting surfaces, which may be provided by different colors, shades, tones, finish, reflectivity, size, shape, or the like, on opposed sides such that when the clubhead 124 moves across the surface 144, the sequins contacted pivot relative to the surrounding non-contacted sequins to provide a visual representation of a divot 150. As described above and elsewhere herein, some embodiments may utilize divot indicating areas 140 including other objects or materials that may be used by the system 100 for divot region analysis of the image data.

The divot indicating area 140 includes one or more markers 146 that may be used by the system as calibration markers for analysis of the image data. The markers include a target line 146*a* representative of a line to a target, which may further be representative of an intended centerline for the shot. A ball location marker 146*b* is provided in line with the target line 146*a* to represent location of a ball to be hit by the swing. Additional markers 146 may also be included, such as one or more angle line markers 146*c* or a perpendicular target line marker 146*d* aligned with the ball location marker 146*c*. One or more of these markers 146 may be used by the subject 114, system 100, or both to orientate the swing or analysis of the image data of the divot region 120, which may also be referred to as a hitting surface or hitting surface area. In the illustrated example, a divot 150 is illustrated having a starting edge 150 perpendicular to the target line 146*a* and that extends along a divot path parallel to the target line 146*a* and perpendicular to the starting edge 150. Also in the illustrated example, the markers 146 comprise sequins having a same color on opposite sides.

The system 100 may additionally or alternatively track a clubhead region 118 corresponding to the clubhead 124 of the golf club 116 at one or more portions of the swing. Image data of the clubhead region 118 may be analyzed to determine tracking data such as a clubhead speed. The system 100 may, for example, analyze clubhead speed through the impact zone 128 to measure clubhead speed. In this or another example, the system 100 may analyze image data of the clubhead 124 to measure clubhead speed during other portions of the swing or to predict clubhead speed through the impact zone 128. As noted above, tracking data that results from analysis of multiple regions may form the basis of ball flight predictions. For example, if clubhead speed is measured prior to the clubhead 124 moving through the impact zone, the system 100 may predict the clubhead speed through the impact zone using the measured clubhead speed as applied to the appropriate model. If analysis of the divot region image data indicates the clubhead 124 contacted the ground surface 126 behind the ball location marker 146*b*, the model may appropriately reduce the clubhead speed that would otherwise have been predicted had the clubhead 124 not hit behind the ball location marker 146*b*.

The system 100 may additionally or alternatively track one or more aspects of the subject's body posture, referred to herein as body posture region 122, during one or more portions of the swing. While many aspects of body posture may be tracked, in the illustrated embodiment the system 100 tracks hands 172, which may include wrists. The system 100 may track hands 172 to determine clubhead speed, which may be in addition to or alternative of measuring clubhead speed via tracking the clubhead region 118. For example, if both the hands 172 and clubhead 124 are being tracked and clubhead speed cannot be clearly determined by analysis of image data of the clubhead region 118, the system 100 may analyze image data of the hands 172 during the swing to predict clubhead speed, which may be the clubhead speed used by the system 100 or may be used to verify clubhead speed determined from analysis of the clubhead region 118. As introduced above, in some embodiments the system 100 may analyze other aspects of body posture. For example, analysis of the hands 172 together or separate of a wrist angle may be correlated with face position of the clubhead 124 to inform face position, angle, dynamic loft, attack angle, or combination thereof. In some embodiments, this face position tracking data may be used to supplement or replace divot region tracking data. Face position tracking data may additionally or alternatively be tracked for output in a graphical representation, separate of use to generate predicted ball flight data. Notably, in one embodiment, face position tracking data may be derived from analysis of the divot region together with or independent of face position tracking data derived from analysis of clubhead image data, body posture image data, or both.

Figure 2:
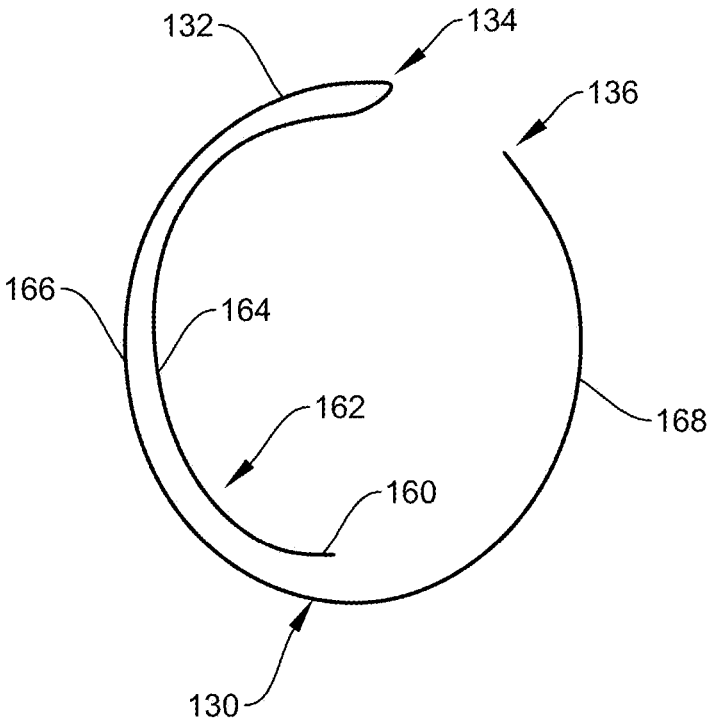
FIG. 2 depicts portions of a swing path according to various embodiments described herein.

With respect to the clubhead region 118 and body posture region 122, the system 100 may be configured to track these regions during one or more portions of the swing, such as, with reference to FIG. 2, during setup 160, takeaway 162, takeaway to club at waist level, or parallel, in backswing 164, club at waist level 164, or parallel, to the top of the backswing 134, at the top of the backswing 134 to club at waist level in downswing 166, club at waist level in the downswing 166 to bottom portion 130 of the swing or through the impact zone 128, impact zone 128 to club at waist level in follow through 168, or club at waist level in follow through 168 to completion of follow through 170. In one embodiment, one or more aspects of body posture selected from wrist angle, hand position, or both may be tracked during one or more portions of the swing from setup 160 through completion of the follow through 170, or anywhere therebetween. In one example, the system 100 may track wrist angle, hand position, or both for analysis to derive data with respect to the clubhead 124, such as a face position, face orientation, face angle, dynamic loft, dynamic loft, clubhead speed, or combination thereof.

The system 100 is configured generate predicted ball flight data from analysis of the image data. For example, the system 100 may be configured to utilize the tracking data derived from the image data of the one or more regions to generate predicted ball flight data. The image data may be analyzed by the system 100, e.g., via a processor 104. For example, the system 100 may utilize processor 104, which may be provided by a server 105, cloud, user device 108, or combination thereof. The analysis may include machine learning, such as artificial intelligence. Artificial intelligence may include computer vision. For example, the system 100 may apply one or more computer vision models trained on image data of actual swings and resulting ball flight including relevant regions to generate predictions described herein. The system 100 includes a database 107 including one or more computer vision models accessible by the processor 104.

Figure 4A:
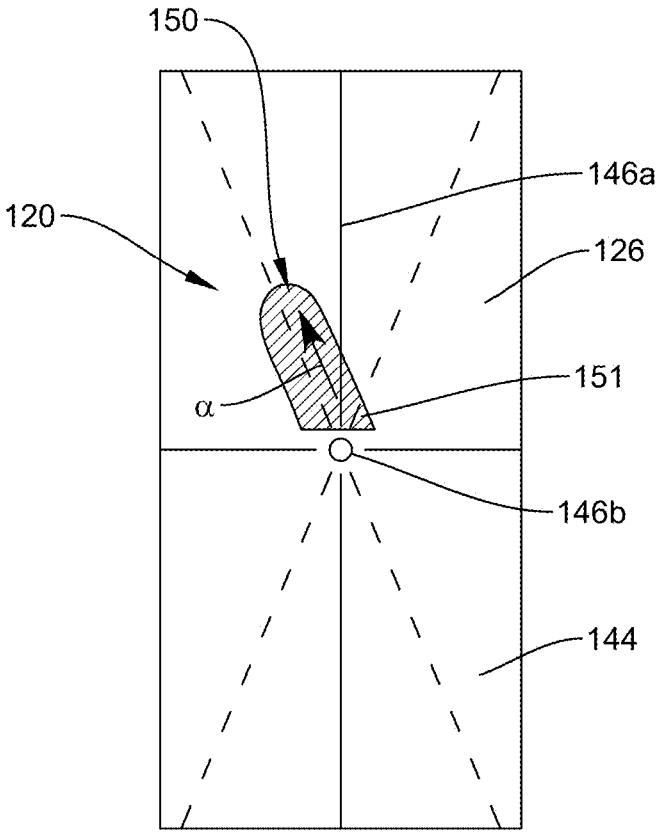
FIG. 4A-4C illustrate divot regions according to various embodiments described herein.
Figure 4B:
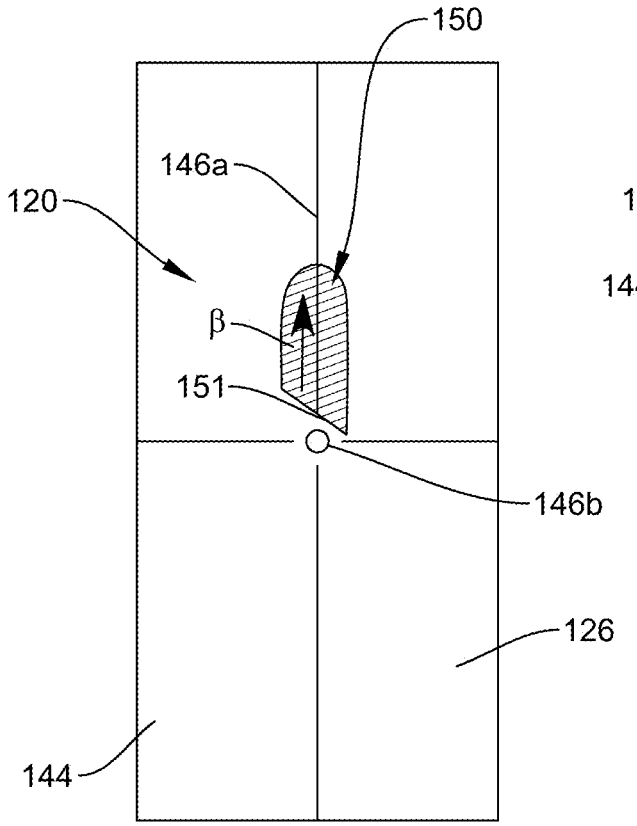
Figure 4C:
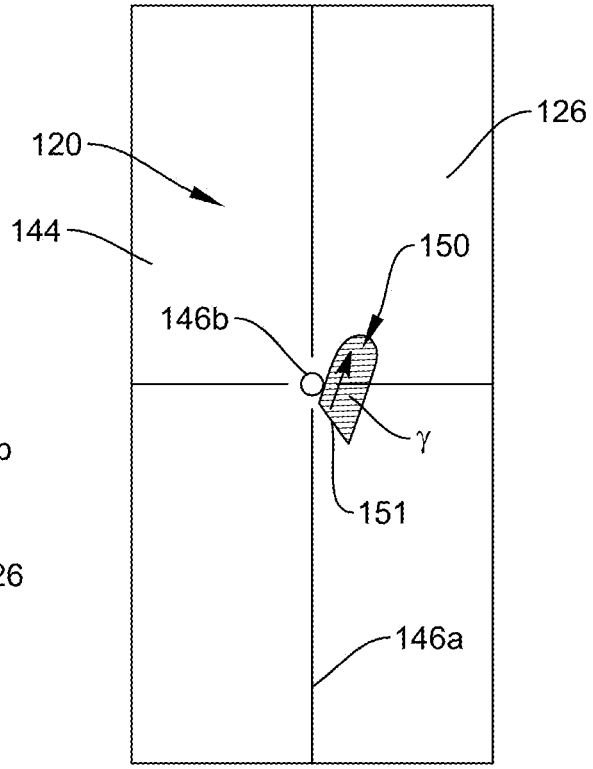

With respect to the divot region 120, example aspects of a divot 150 the system 100 may analyze may include one or more of the divot shape, direction of divot path, starting angle, path length, or path relative to the target line 146*a* or ball location marker 146*b*. The resulting tracking data may be utilized alone or together with tracking data generated from analysis of other regions to generate predicted ball flight data described herein. For example, tracking data comprising clubhead speed derived from analysis of image data of the body posture region 122, clubhead region 118, or both may be combined with the tracking data generated from the analysis of the divot region 120 image data to predict ball flight. As an example, with reference to FIG. 4A, a divot 150 having a starting edge 151 square to the target, i.e., perpendicular to the target line 146*a*, and that extends along an outside to inside path relative to the starting edge 151 may predict ball flight movement to the right of the divot path, indicated by arrow a. Greater clubhead speed may increase both the predicted travel distance of the ball as well as the predicted rightward movement. The degree of the angle of the outside to inside divot path a may also impact the predicted degree of rightward movement, with more rightward movement being predicted with divot paths a that deviate by a greater angle from a line perpendicular to the starting edge 151 of the divot 150. As another example, with reference to FIG. 4B, a divot 150 having starting edge 151 that angles outside to inside and that increases in width may indicate the swing created a dynamic lie that was too flat, causing the toe of the club to contact the ground surface 126 first, which may predict a ball flight that starts right of the divot path, indicated by arrow B. In this example, the system 100 may incorporate this rightward directed trajectory into the predicted ball flight. In FIG. 4C, the divot 150 is behind the ball location mark 146*b*, indicating a reduction in clubhead speed prior to impact, which the system 100 may interpret as a reduction in distance, height, or both that the ball would otherwise be predicted to travel. The divot path, indicated by arrow Y, is inside to outside and the inner edge 152 runs through the ball location mark 146*b*. In this example, the system 100 may predict a ball flight that includes a shank to the left. It is to be appreciated that the system 100 analysis may consider additional aspects of the divot region and/or other regions, such as proximity of the inner edge 152 to the ball location mark 146*b*, clubhead speed, or both, when generating the predicted ball flight. As described above, some embodiments may additionally or alternatively perform analyses of the clubhead region 118 and or body posture region 122 to, for example, identify club face orientation at one or more portions in the swing. In one embodiment, the system 100 may analyze image data of the clubhead region 118 at impact or simulated impact at the ball impact marker 146*b* to identify an attack angle, face angle, dynamic lie, or dynamic loft, which may be alone or in combination with analyses of the divot region 120 and/or body posture region 122.

In some embodiments, the system 100 may generate predicted ball flight without divot region 120 image data. For example, the system 100 may utilize image data of the clubhead region 118 to identify one or more of face angle, dynamic loft, dynamic lie, attach angle, swing path, or clubhead speed. Using this tracking data, the system 100 may predict a corresponding ball flight. In another or a further embodiment, the system 100 may utilize image data of the body posture region 122 to identify one or more of face angle, dynamic loft, dynamic lie, attach angle, swing path, or clubhead speed. The system 100 may derive swing variables by tracking hands, wrists, forearms, arms, or combination thereof. Using computer vision, for example, the system 100 may utilize models trained on actual swings and actual resulting ball flight data to predict ball flight from the image data.

Tracking data may include or be utilized to output ball flight variables, integrate a simulation, or combination thereof. For example, tracking data, a graphical representation of the tracking data, or instructions for generating a graphical representation incorporating the tracking data may be provided to a user device 108 having a graphical display 106. In the illustrated embodiment, with further reference to FIG. 3, the user device 108 executes an application. The application is configured to integrate with the operations of the camera 102 to collect the image data of the swing. The image data is analyzed by the processor 104, e.g., using one or more computer vision models, to generate tracking data, which may include or be utilized to generate predicted ball flight data.

The system 100 is configured to output the tracking analysis in a graphical format to provide a user with information regarding a tracked swing, ball flight, or both. In one embodiment, the tracking data output includes a computer animation of the swing incorporating swing variables derived from the analysis of the image data. The computer animation may be included within the operation of the golf simulator or in a different graphical representation. The predicted flight path, which may include related variables, may then be plotted within a simulated environment. For example, the tracking data may be utilized to generate a computer animation of the swing, ball flight data, or combination thereof. In the illustrated embodiment, the application includes a golf game that provides golf simulator functionality without the use of a ball. In one example, the application includes a selection of interactive holes, courses, or golf challenges that a user may select.

Figure 3:
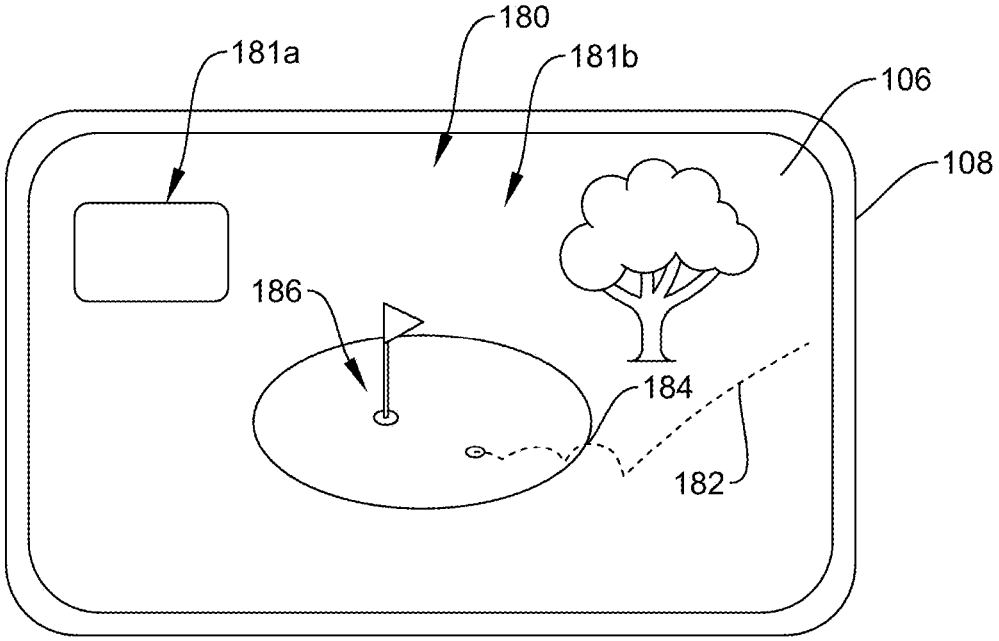
FIG. 3 depicts a user device having a graphical display that displays a golf game utilizing ball flight data generated by the system according to various embodiments described herein.

With reference to FIG. 3, the tracking data derived from the analysis of the image data may be integrated into a graphical representation 180 on the graphical display 106. The graphical representation 180 may include numerical or text-based graphics 181*a*, computer animated depictions 181*b* of the data, or both. As introduced above, the graphical representation 180 may include a golf game or simulation including a computer animated depiction of the predicted ball flight 182. The graphical representation 180 may further include predicted ball interactions 184 at or following predicted impact utilizing the ball flight data and variables of a representative simulated surface. Ball flight variables may also be output in numerical, graphical, or other text-based format 181*a*. Example ball flight variables may include apex, carry distance, total distance, carry deviation from a target center line, total deviation from a target centerline, or combination thereof. Additional variables may include, for example, one or more clubhead variables such as clubhead speed, tempo, attack angle, face angle, dynamic lie, or dynamic loft, one or more ball flight variables such as one or more of exit velocity, trajectory, or spin profile, or combinations thereof. Any such variables may also be incorporated in animated depictions 181*b* of the data. The computer animated depiction 181*b* may also include a depiction of a golf hole 186 or other shot target. It will be appreciated that the ball flight variables or associated data may be transmitted to the user device 108 for integration in the simulation or the simulation may be transmitted to the user device 108 or graphical display 106, which in some embodiments may be separate from the user device 108 that executes the application.

Further to the above, the system may include or operatively communicate with an application operable to control a camera or receive image data captured by a camera. In one example, the application may include a mobile application and is configured to integrate operations with mobile user device, such as a smart phone, tablet, or similar device to capture image data with respect to a user swing.

Processing operations maybe performed on the user device, by another processing devices in communication with the user device to receive image data or portion thereof for processing and return to the user device, or combination thereof. The processing device may comprise a server, a cloud computing environment, networked device, which may include local or remote computer equipped with suitable processing capabilities to execute or assist in execution of one or more processing operations. In one embodiment, a portion of the processing may be executed on the user device, e.g., on-premises, which may be referred to as client side processing, during the capture of the image data. In this or a further embodiment, a majority of processing is GPU/TPU compute on a combination of cloud servers working in parallel. For example, the processing done on the user device may include swing completion detection by processing the existence of a divot. For instance, swing completion detection by processing the existence of a divot at any point in time. In this or another embodiment, user device or client side processing may include tracking body motion, hand motion, or both to automatically cause the image capture to stop and assist with GPU workload. Server side workload may include data construction such as video trimming, rotation and flipping for left handed players, loading in data points from the user device, among other processes.

As noted above and elsewhere herein, the image data will typically include sequential image frames captured by video. For example, the system, which may include the application working therewith, may support any frame rate and video resolution, such as 60 fps, 120 fps, or otherwise available. In one example, the application supports video of a swing in 120 fps with variable video resolution. With respect to known smart phone and tablets, front facing camera are typically equipped with superior cameras having higher frame rates and resolution. Therefore, superior images may be obtained employing such front facing cameras and the system may preferentially utilize such cameras. However, the system may be configured to utilize rear facing cameras or both front and rear facing cameras. Indeed, the system may be configured to use multiple cameras, e.g., multiple front facing cameras, on the same user device. Using multiple cameras may be used to enhance frame rate and video quality. In one embodiment, the system is configured to include of communicate with an application that executes on a user device and be further configured to connect wireless or via a wired connection to one or more external cameras. The one or more external cameras may be in addition or instead of one or more cameras incorporated or otherwise associated with the user device. The user device may include a graphical display screen for display of shot simulation data, such as that described herein. Additionally or alternatively, the user device executing, simulating, or otherwise providing the application may wirelessly connect or wirelessly connect to a graphical display screen to receive and display the shot simulation data.

System Processing Examples

Example 1

In one embodiment, the system is configured to extract data points from video data captured of a golf swing. The data points may be extracted, for example, from analysis of the body posture region, divot region, clubhead region, or combinations thereof during the swing. The analysis of the respective regions may include data points and variables derived or otherwise informed therefrom such as those described above and elsewhere herein. In one example, this extraction may be executed in parallel.

The system may employ inference to predict a plurality of points of body posture at every frame using a fine-tuned top-down video model. The system may further identify a plurality of key points throughout the captured video. For example, the key points may include impact. Impact may be determined to the point of contact with the virtual ball, which may also be an actual ball if so positioned to correspond with the virtual ball. This may be predicted using the existence of a divot at every frame. For instance, the frame at which the divot begins to expand is the frame of impact. In one embodiment, this process may utilize an image object detection model made to predict the location of the hitting surface, which may be a mat, in the video, and the existence of a divot on the hitting surface. As described in greater detail elsewhere herein, in some embodiments, detection of the hitting surface may include detection of location of a ball indicator that may be used by the system in extraction or prediction generation with respect to variables impacted by predicted location of impact and location of the virtual ball, such as club speed, attack angle, face angle at impact, and the like. In some embodiments, the prediction may be enhanced later via other collected variables such as those corresponding to body posture (e.g., extracted from body posture region), clubhead location (e.g., extracted from clubhead region), or others. The frames at which other points exist may be similarly predicted, such as address, top of the backswing, and finish. These predictions may be derived from data point extraction from the image data with respect to body posture, divot, club position, or combination thereof. For example, data points of body posture or body posture variables may be used to predict the image frames. Example of address determination may include one or more of image frame prior to initiation of a takeaway, such as linear movement of hands, wrist, or club shaft or clubhead backwards or away from the ball location indicator. Example top of backswing may include frame with highest hand, wrist, or club grip position or frame preceding forward movement of the same along the club path. Example of finish determination may include one or more of last frame in which hands, wrist, or club are tracked along the arc of the swing path or highest position of the same following appearance of the divot. The system may predict a club inference. For instance, at some frames the system may predict club angle relative to the camera. In one example, this may utilize an image segmentation model that is configured to predict the angle of the club in any image frame. The system may be configured to make a clubhead position inference. For instance, at some frames, the position of the clubhead relative to the camera is predicted. In one example, this process may utilize an image pose detection model. The system may be configured to identify and estimate the size of hitting area. This may be used for determination of divot dimensions and other divot variables. In one embodiment, the system is configured to identify and estimate the size of the divot without estimating the size of the hitting area, e.g., using optically detectable markings on or near the hitting surface having known size, such as known length and width, optical markings having known spatial relationship, or using depth and camera view angle analysis. The system may additionally or alternatively use identification aspects of the hitting surface, e.g., boarders, optically detectable markings, or the like to determine directional orientation, e.g., for intended target direction. Size determination may include determining the angle of the hitting surface or divot with respect to the camera. In one example, determining the size of the hitting area, divot, or both may include using a depth perception algorithm or computer vision, for example. An image transformation with respect to the hitting surface may include projective registration or projective transformation, such as a homography transformation, of the hitting surface by, for example, projecting it onto a 2D plane. Additionally or alternatively, the divot may be binarized. For instance, a frame at which the full divot exists (such as the swing finish frame) may be selected. An image object detection model or similar may be employed to detect what kind of hitting surface or known dimension the hitting surface is. An image pose detection model may then be used to extract the corner points of the hitting surface. The contents enclosed by the corner points may then be projected onto the 2D plane. Projection may differ based on what kind of hitting surface is present as the dimensions of the surfaces may be different. An image segmentation model may then be used to binarize the hitting surface into divot and non-divot. The binarized image may be saved for later use.

The embodiment may optionally employ video enhancement techniques achieve improved accuracy in predictions from video and image models. For example, an optical flow algorithm may be use to take multiple sequential frames in a video and highlights the points that have moved. Applying this adapted algorithm, the system may track where motion has occurred at any location in the video and which linear direction the pixels moved. Direction may be color-coded and the area undergoing the movement may be highlighted to generate an enhanced image. The enhanced image may be fed to the image models such that both temporal and spatial information is represented in the still image.

In one example, the system may combine all sources of data into a continuous workflow and perform additional data extraction. In a further example the sources of data may be combined into a continuous workflow on one server. The additional data extraction may include extracting raw data points from the binarized divot. The process may utilize a suitable algorithm, such as algorithms well-known in the art, to obtain values for a plurality of divot variables such as those associated with surface area, contour shape, linear and multiple regressions along the divot, directions and directional changes, spreads/height of divot. In various applications, this extraction may produce around 100 or more data points per video. As noted above, various pixel intervals may be used, which may be the same or different for respective variables. In one example, directions and directional changes and spreads/height of divot may be taken at every pixel interval. Raw data points from points of body posture may also be extracted to produce around 100 or more additional data points per video. In this process, known algorithms may be applied to track body posture changes such as changes in knee bend, shoulder rotation, velocity and acceleration of wrists, moving weight from one foot to another, elbow bend changes, or other changes, such as those described elsewhere herein. If the hitting surface comprises a mat or other surface susceptible to motion when contacted by the golf club, the system may optionally generate motion data that accounts for and incorporates the motion into the flight path prediction and certain variables used to generate the prediction. For example, a hitting surface mat may minimally manipulate its body after being hit. Many manipulations are possible such as the shape may momentarily distort or a pad under the surface may shrink to lower the surface for one or more frames. The hitting surface may also move a few centimeters due to contact with the club. The system may record these manipulations with the aforementioned models and algorithms. In one example, this may produce an additional 10-15 or more data points per video. The system may utilize the binarized divot image and raw data points to make non-final predictions about for key variables. For instance, a multi-regression model that acts as a multi-modal network may take both the binarized divot image and some of the raw data points collected above appended in some of the post-CNN layers. This model may output a non-final prediction for key shot variables such as apex height, club path, club face angle, club direction, launch angle, club speed, carry distance, deviation distance, total distance, or additional variables. Key variables will typically be variables that heavily influence ball flight attributes, are included in ball flight attributes, or that are desirable for output for informational purposes to the users. In one example, the non-final shot variable predictions produce around 15 or more variables.

To generate the final predicted ball flight the system may be configured to perform tabular data processing and inference. In one example, standard machine learning techniques such as PCA are applied to reduce feature size. In this or another example, pre-processing techniques such as hot encoding, standardization, normalization, or combination thereof may be applied to variables that are fit for such. The system may employ a sequential ensemble of models, generally consistent of XGBoosts and LGBMs to generate enhanced non-final and final variables and produce a final ball flight prediction result. For example, a selection of club speed related variables like wrist velocities, club angles, clubhead positions, and multi-regressor outputs may be input into an ensemble of models, a standalone regressor XGB, or XGBs, to output predicted non-final club speed. The same may be performed to predict final shot variables such as apex, launch angle, direction, club speed, ball spin, ball speed, smash factor, and similar, such as non-distance shot variables. In one example, this may be performed in parallel with multiple standalone XGBs. The system may also use a combination of the aforementioned variables to predict enhanced non-final carry distance, deviation distance, and total distance using a model ensemble. In one example, multiple predictions from each model in the ensemble may be output. The system may then employ a final model that takes all the ensemble outputs and produces a final result comprising a predicted flight path of a simulated ball.

As noted above and elsewhere herein, the system may include or operatively communicate with an application that is executed on, simulated on, or otherwise provides a user interface and handles data transfer between a user device and server-side processes, when present, graphic rendering, client-side processing, or other operations from a user device. The user interface may include a display that displays graphical image and information, such as a course or other venue, landscape, or game environment within which predicted ball flight, predicted final resting position, predicted ball behavior with respect to bounce and roll, or combination thereof may be generated for display. As noted above, various predicted variables may be displayed or displayable within the graphical presentation. For example, the display may provide values for carry distance, total carry, and deviation may be displayed.

Example 2

In various embodiments, the system may be configured to perform data extraction from image data captured of a swing. The image data may comprise video captured of the swing. In some embodiments, the data extraction includes analysis of a body posture region, divot region, clubhead region, or combinations thereof during the swing. The analysis of the respective regions may include analyses to extract or detect data points and variables derived or otherwise informed therefrom, such as those described above and elsewhere herein.

The image data may be processed with respect to a divot region for detection or extraction of hitting surface related data points, which may include variables or variables derived or otherwise informed therefrom. For example, detecting variables of a hitting surface may include image registration of hitting surface. For instance, size and orientation of a hitting surface may be determined for further processing. In one embodiment, the system is configured to estimate a size of a hitting area using depth perception algorithm or computer vision. This may further include processing to estimate a size of a divot, e.g., impact mark, in this or subsequent processes. In one example, angle of camera view is determined to generate an absolute truth state with respect to the divot. For instance, a camera view will typically capture images at an angle relative to a proportioned top down view thereby modifying size and orientation relative to such a view. One or more transformation techniques may applied to a hitting surface area in the image data to establish a ground truth with respect to further processing steps. In some embodiments, the hitting surface area may be projected onto a 2D plane, for example, to extract absolute value for application to subsequent divot measurements. As described in more detail below, the 2D projection or other transformation may be used to segment out the divot and perform various computations on the divot segmentation. In a further or another embodiment, the hitting surface, divot area, or divot may be binarized for divot segmentation.

In embodiments wherein the hitting surface comprises a mat, detecting hitting surface variables may include detecting mat related variables such as the location of the mat, detecting corners of the mat, or both. If the mat is one of known variable values, such as size, color, among others, the system may be configured to detect what kind of mat is being used, e.g., using color detection, size detection, marking detection, among others. In one example, detected mat corners may be used to process the mat to segment out the divot. Detection of hitting surface variables with respect to registration or may utilize any suitable model technique. For instance, image object detection models may be used. In one example, image object detection models may be used to detect mat location and kind of mat and an image pose detection model may be used to detect corners of the mat. In some embodiments, mat or otherwise hitting surface dimensions may be determined by computer vision or other suitable technique. Various computations may be performed on the divot segmentation, e.g., one or more of surface area, length, starting and ending point vertically and horizontally, linear angle, multilinear angles, spread top to bottom, or shape.

The hitting surface image data, which may include mat image data, may be analyzed to identify an image frame including a full divot. As noted above, detected or defined area of the hitting surface may be used for registration or transformation of the hitting surface that accounts for hitting surface size and orientation. The image data of the hitting surface area may be transformed, e.g., projected onto a 2D plane for segmentation of the surface, e.g., divot, no divot. In a mat use case, detected mat corners and mat kind may be used to project the hitting surface onto a 2D plane, and the 2D projection may be binarized, e.g., using a suitable model such as an image segmentation model. In one example, kind of mat falls into N by 3 wherein N is number of known mat variations and 3 is divided into divot, no divot, no divot with ball or ball mark, e.g., as there is not a divot with ball, since the ball was hit already. This may be run on multiple image frames of the video wherein there may be no divot at all in some frames, a frame including an initial partial divot, which may be set as point of impact, and thereafter a frame or frames will include complete divot. While full divot frames may be utilized for divot analysis for shot variable prediction in some embodiments, in other embodiments, image frames of partial divots may also be used. For example, two or more sequential image frames may be used that capture the temporal creation of the divot.

In some embodiments, a ball mark or other ball indicator may be provided on the hitting surface to define the position of the virtual ball to be hit. In various embodiments, extraction or detection of hitting surface parameters described herein may include identification of the location of the ball indicator. For example, the system may analyze the image data prior to divot creation to identify the location of the ball indicator as the virtual ball target of the swing. Analysis of the divot location as described herein may include generation of divot variables, which may include divot related shot variables, related to predicted impact with the ball instructed by the divot location and the location of the ball indicator. For instance, a categorical prediction with respect to a fat, thin, or pure shot or degree thereof may be generated. A prediction with respect to distance of turf contact before or after the ball may be generated. The analysis may generate data points or variables applicable to various variables generated by the system, e.g., applied models, such as face angle at impact (club twist due to fat shot), ball spin, attack angle, club speed at impact (deceleration due to fat shot), ball speed, smash factor, among others. In other embodiments, location of a ball indicator is not considered and impact as informed by the analysis of the divot is also taken as the location of the ball.

The system may be configured to extract points of body posture in a body posture region analysis through one or more points or stages of the swing to predict body posture. For example, the location of both identifiable parts and non-identifiable parts, inferred, may be predicted. The body points may be identified through the swing. As not all body points may be visible throughout the swing, the system may be configured to infer body posture in some frames. In one embodiment, body posture is predicted or inferred in every frame throughout the swing, e.g., from the top of the back swing to follow through or from address to follow through. Points of body posture may be identified utilizing any suitable algorithm or model. For example, a video model, such as a fine-tuned, top-down video model. In another or a further example, one or more image models may be employed. Various points of body posture may be identified, such as points selected from but not limited to eyes, ears, hips, knees, ankles, shoulders, elbows, wrists, nose, among others. The system may be configured to infer location of points of body posture for points that may be obscured or otherwise not visible in the image data. For example, if a hand is not initially visible or becomes obscured during the swing, the system may estimate the hand location in the frames it is not visible.

The system may be configured to analyze the image data to detect points or frames capturing to one or more points of the swing, such as one or more of backswing, follow through, impact, address, among others. The detection may be of a single frame representing a boundary of a swing stage or swing stage event or a set of frames representing a portion of a swing. The detection may employ other data extracted from the images or may be performed in isolation. For instance, image data may be analyzed for ball impact. Ball impact may be taken as a frame in which a divot first appears. Detection of swing points may be determined utilizing any suitable algorithm or model. For example, computer vision may be employed, such as application of an image object detection model. As noted above, various swing points may be predicted. These predictions may be derived from data point extraction from the image data with respect to body posture, divot, club position, or combination thereof, as described above, e.g., with respect to Example 1, or elsewhere herein. For example, swing points in addition to impact may include an address frame, top of back swing frame, and a finish frame, which may be the highest point of follow through. In one example, swing point predictions include one or more of point of impact, highest point of backswing, lowest point of backswing, or highest point of follow through. This information may be used for subsequent analysis by one or more models. For example, additional frames for models may be identified from the predicted swing points. Some models may utilize +/−frames around the swing point. Thus, is a model utilized +10/−10 frames around impact, 20 additional frames around impact may be identified. Other models may require an intermediate set of frames. For instance, a backswing set of frames may include frames between address and downswing swing points.

In some embodiments, impact may be predicted at the start of the divot. The position of the start of the detected divot may be used relative to a ball or virtual ball location marking on the hitting surface. In another embodiment, initial contact with the ball is predicted a distance from the start of a detected divot. For example, an arc of a swing path may result in impact with a ball or virtual ball prior to contact with a hitting surface, such as one to four inches before turf contact. Thus, in some embodiments, impact may be predicted at a particular distance prior to, e.g., before the start of the divot. Thus, the impact frame may be predicted at an image frame a corresponding frame rate before the first appearance of a divot. This may take into account a measure or predicted club speed. For instance, the club speed at or near the impact zone may be used, prior information regarding the player may be used, e.g., consistent with club speed measured for a particular club, club type, or shot corresponding to the current shot.

The system is configured to analyze the image data to extract data points with respect to club and associated features, which may be referred to club variables. For example, the system may identify club angle. The system may employ any suitable algorithm or model capable of directly or indirectly inferring angle of the club relative or non-relative to the camera. In one example, an image segmentation model is employed. In an above or another example, the system may be configured to analyze the image data to identify clubhead position. The system may employ any suitable algorithm or model capable of directly or indirectly inferring angle of the clubhead position relative or non-relative to the camera. In one example, an image pose detection model is employed.

In one embodiment, the system is configured to perform the above data point extraction processes from the image data in parallel. In this or another embodiment, the system may optionally employ video enhancement techniques to generate more accurate predictions from video and image models. Optical flow is a general algorithm that takes multiple sequential frames in a video and highlights the points that have moved. In one embodiment, the system employees an adapted algorithm to track where motion happened at any location in the video, and which linear direction the pixels moved. In one configuration, direction may be color-coded and the area that has moved may be highlighted. Image models may be fed the enhanced images to produce temporal and spatial information represented via a still image.

The system may be configured to utilize the segmented hitting surface data, such as a binarized hitting surface, e.g., mat image, to extract divot variables. As described in more detail below, the divot variables may be used to infer information about ball flight attributes used in ball flight predictions. There are many known divot detecting surfaces known in the art, and the particular divot variables extracted will generally relate to the type of hitting surface in which the divot is made. For instance, divots formed in a fiber surface wherein the fibers offset to reveal a color or texture change relative to adjacent fibers will differ from a grass/sod surface, a thermal responsive surface in which contact with the surface causes color changed due to contact friction, a deformable surface that deforms when contacted by a club, a surface responsive to changes in a magnetic field that produces color or contrast changes in regions contacted by a club, or a surface with pivotable objects that pivot when contacted by a club to produce a color difference, texture difference, or both with respect to the surrounding hitting surface. As such, those having skill in the art will be able to ascertain upon reading the present disclosure suitable divot variables and appreciate that the present disclosure is not limited to the divot variables identified herein. In various embodiment, extracting divot variables may include analysis of color/contrast, texture, or other divot indicating differential with surrounding hitting area. In one example, the hitting surface comprises pivotable objections comprising colored sequins as is known in the art. Each sequin will typically have sides of different color such that when in non-pivoted or base position, the sequins together present first sides and corresponding first color and when contacted and pivoted to one or more second positions, the pivoted sequins present, depending on degree of pivot, less or none of the first side, at least a portion of the second side and corresponding color, or combination thereof. In one embodiment, the system is configured to analyze the hitting surface data, such as a binarized hitting surface, e.g., mat image, to extract divot variables including one or more of surface area, contour shape, linear or multiple regressions along the divot, directions or directional changes, spreads/height of divot, or combination thereof. In some examples, one or more of the variables may be taken at pixel intervals. For instance, one or more variables may be taken at every pixel interval or at an otherwise determined interval such as at 10 pixel intervals, 5 pixel intervals, or 2 pixel intervals. One or more variables may be taken at intervals different than one or more other variables.

The system may be configured to utilize extracted body posture points to track body posture changes during the swing to extract body posture variables from the image data. Body posture variables may include various posture values or changes thereof with respect to a swing. Body posture variables may also include action/motion data of the points of body posture. Non-limiting examples of body posture variables include knee bend, shoulder rotation, velocity and acceleration of wrists, weight shift (moving weight from one foot to another), elbow bend, arm angles, wrist bend, hip turn, head position, hand position, spine angle, feet position, angle bend, ankle spacing, elbow spacing, among others. Values for body posture variables may be taken across one or multiple image frames. This will typically depend on the variable. For example, simple postural variables, such as like coordinates (e.g., x,y of left wrist), bends (e.g., knee bend, elbow bend, hip bend, upper arm to shoulder bend), or spacing (e.g., left to right ankle, left to right elbow spacing, wrist or hand spacing with respect to shoulders) may be taken from individual frames, and may be further taken from multiple points through a swing, such as at impact, a few frames within the impact zone, e.g., before and after impact, or at other points such as downswing, club parallel, top of backswing, end of follow through. Some variables may be taken from analysis of multiple image frames. For instance, velocity of wrists, wrist acceleration may be taken from a window size of 1, 2, or N image frames, which may be taken at one or more relevant points or periods of the swing. Some body posture variables may employ moving averages rather than raw coordinate values. For instance, an average coordinate across each N window of frames may be taken velocities may be drawn through those averages. In various embodiments, the body posture values may be provided normalized against some variable and relatively. Body posture variables may be determined using basic algorithms known in the art or models, such as those suitable for tracking movement or orientation.

In embodiments wherein captured image data includes a hitting surface comprising a mat or other surface susceptible to shape distortion, movement, or shrinkage, the system may optionally be configured to generate hitting surface, e.g., mat, motion data. For example, a set of image models or other technique may be used to produce features to calculate hitting surface motion variables such as shape distortion, movement, or shrinkage of the hitting surface. In one embodiment, an image segmentation model may be employed that highlights the hitting surface and an image keypoint model (e.g., pose detection model) is employed that extracts coordinates of the corners or edges of the hitting surface, such as four corner points of a primary mat hitting surface. The image segmentation, for instance, reveals the shape of the hitting surface, e.g., mat. If the hitting surface is moving or is being distorted in any given frame, it may show more of a curvature and not have straight vectors going along its edges. Image keypoint detection reveals from one frame to another whether the hitting surface has moved. When the camera is stationary, it is assumed that any deviation from original coordinates corresponds to movement. In various embodiments, motion and shape variables may be utilized in boosting models, such as those described below, as raw numerical features. Example motion data may include coordinate representation movement such as x11-x12 mat movement, y11-y12 mat movement, representing where the mat was before impact at x1 and how far that point moved after impact to x2. This may be similarly applied for y and other corner points. Shape aspects may include multiple associated variables, for example, that calculate vertical distance or draw an estimated multinomial across each edge. For instance, for a polynomial to 2nd degree with 3 variables may include a, b, c variables for top polynomial (edge furthers from camera) and some for bottom edge (edge closest to camera).

In one embodiment the system is configured to encode a divot and use it inside of a model in order to predict or help predict or generate features for ball flight attributes. The predicted shot variables may be generated by an image-based or convolutional model capable of extracting information from a divot. In a further embodiment, the model takes additional inputs such as those described herein with respect to body posture. Additionally or alternatively, the model may take additional inputs with respect to club or clubhead position. For example, generation of the shot variables may incorporate body posture variables, hitting surface distortion variables, hitting surface motion data, hitting surface calculations, or combinations thereof. In some embodiments, additional variables may be included such as historical user data. Historical user data may include the user's height, skill level, target distance, accuracy of the last few shots, among others. In an above or another embodiment, shot variables are generated from inputs including divot variables, body posture variables. The inputs may be input into a multi-regression model to output shot variables selected from but not limited to apex height, club path, club face ancle, club direction, launch angle, club speed, carry distance, deviation distance, ball speed, smash factor, ball spin, direction, among others. In one embodiment, one or more of the output shot variables may be considered non-final shot variables that are subject to further calculation. The non-final shot variables may be used to generate additional non-final or final shot variables.

In one example, the system is configured to combine the sources of data from the data point extraction processes into a continuous work flow and execute the above processes with respect to the body posture variables, divot variables, hitting surface motion data variables, and shot variables.

The system may be configured to utilize the data extracted or generated above to predict final shot variables for generation of a predicted ball flight for simulation application as described herein. In one example, this may optionally include generating one or more additional non-final shot variables or enhanced non-final variables. According to one configuration, predicting the final shot variables may include tabular data processing and inference.

Pre-processing may optionally be applied to one or more of the above extracted or generated data. For instance, feature size may be reduced using machine learning techniques such as principal component analysis (PCA) or other suitable technique. In this or another example, pre-processing techniques such as hot encoding, standardization, and normalization may be applied to variables that are fit for such.

Generation the predicted shot variables and predicted ball flight may be executed using suitable modeling techniques currently known or later developed. For example, the shot variables and ball flight may be predicted utilizing a trained sequential ensemble of models. In one example, the model ensemble may be consistent with XGradient Boosts (XGB) and Light Gradient Boost Models (LGBM).

As noted above, the system may be configured to predict one or more enhanced non-final shot variables. For example, an enhanced non-final shot variable is a subsequent non-final shot variable of a previously generated non-final shot variable. The enhanced non-final variable may benefit from additional generated data. For example, in such an additional step, the model may take less features from the above processes than the previous calculation. This gives models all the information needed while reducing dimensionality of the data set, e.g., less features will equate to less overfitting. In one embodiment, the system is configured to generate an enhanced non-final club speed. This may include inputting club speed related variables in to a model. This may include club angle, wrist velocities, clubhead positions, and relevant non-final shot variables such as the non-final club speed. In one embodiment, this enhanced non-final club speed variable prediction may be generated by employing an ensemble of models or XGBs. In one configuration the model comprises a standalone regressor XGB. In another embodiment, club speed is predicted by calculating movement of the clubhead between image frames when sufficiently visible in the such image frames without additional input from other club speed related variables.

In one embodiment, the system may be configured to predict a club vector. For instance, a plurality of points may be used to predict the vector. As an example, a first point, e.g., top point of club grip, in relation to the user, a second point of each hand on the grip represented by how the user's hands are gripping, and in 3D which direction the club is facing, e.g., length in X, Y, Z, hence three points.

The system may be configured to predict final non-distance shot variables selected from but not limited to apex, launch angle, direction, club speed, ball spin, ball speed, smash factor, among others. The model may take as input above processed values or a selection of features thereof. For example, inputs may include body posture variables such as wrist velocities or other pose estimation velocities, extracted data points, club angles, non-final shot variables, enhanced club speed non-final variable, or other values. In one embodiment, the final non-distance shot variable predictions may be generated by employing an ensemble of models or XGBs. In one configuration the model comprises a standalone regressor XGB.

The system may be configured to predict enhanced non-final distance shot variables such as carry distance, deviation distance, and total distance. For instance, the enhanced non-final distance shot variables may be generated using a model ensemble. The ensemble model may take the predictions from the above models, which may include multiple predictions from each model in the ensemble. For example, final non-distance related shot variables including apex, launch angle, direction, club speed, ball spin, ball speed, smash factor, and similar. As the example is an ensemble multiple preprocessing steps, some variables may be thrown out, while others may be heavily weighted. As noted above, pre-processing may be used to reduce dimensionality, so each model in the ensemble may get a different set of features to process due to relevance. As such, less relevant features may be automatically thrown out by preprocessing. In the above example, Each model in ensemble may be configured to output one prediction. For instance, one model may output carry distance and one prediction per model run. Together, the ensemble may be designed to output the enhanced non-final distance shot variables.

The system may be configured to predict final distance shot variables. This may be executed using a subsequent or final model in an ensemble that receives as input the ensemble outputs, which may include all the ensemble outputs to output final distance predictions such as carry distance, deviation distance, and total distance. In one implementation, the final model may include a gradient boosting model that combines all the outputs from the ensemble models, and produces a final output. In one example, the outputs from the ensemble models are the only inputs. Each final model may be dedicated to one output, such as carry distance final model. For instance, the model may take all prior variables output from the ensemble.

Figure 5:
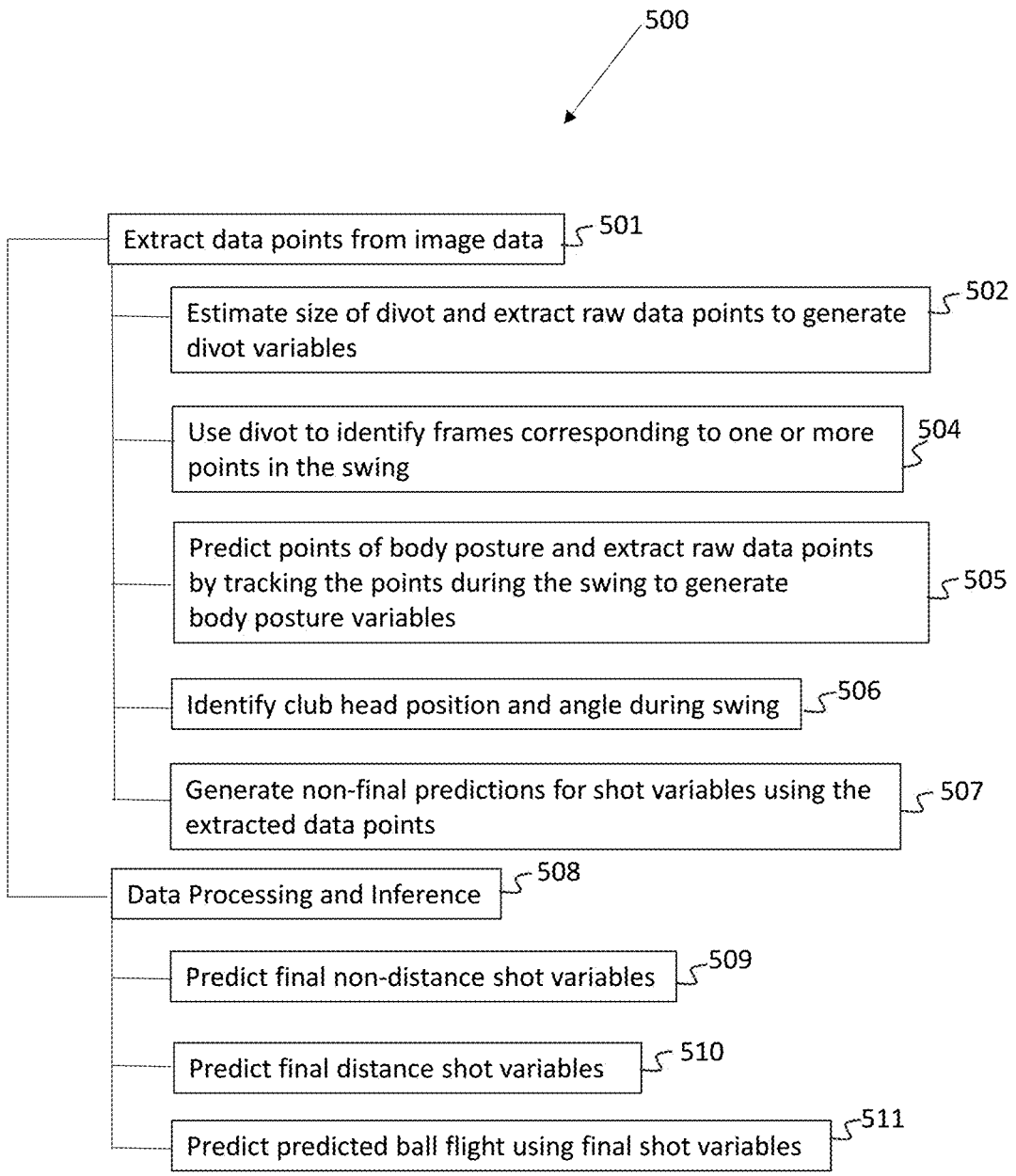
FIG. 5 illustrates a method of predicting a ball flight path from image data captured of a swing including a divot according to various embodiments describe herein.

FIG. 5 illustrates a method 500 of predicting ball flight utilizing image data of a golf swing that does not require a ball.

The method 500 includes extracting data 501 points from image data of a golf swing 501. Data point extraction 501 may be performed using any suitable technique, such as any of those described herein, e.g., with respect to Examples 1 & 2 or elsewhere.

Extracting the data points from the image data 501 may include estimating size of the divot and extracting raw data points to generate divot variables 502. Extraction of raw data points to generate divot variables 502 may be performed using any suitable technique, such as any of those described herein, e.g., with respect to Examples 1 & 2 or elsewhere. In one example, estimating size of divot comprises detecting hitting surface parameters 502. In one example, hitting surface parameters may include dimensions that the system may detect and utilize to one or both of orientate or scale images. For example, size and position of the mat may be used to orientate the intended shot direction and hence provide information that may be used in one or both of divot or swing path analyses. For example, if a divot angles away from the intended shot direction, this may indicate an in-to-out swing path that can be used together with face angle at impact and other variables to predict shot direction, spin, shot shape, and distance related variables. In some embodiments, the method may be performed with a hitting surface that does not include a mat or otherwise on a surface that does not have initially known dimensions. In one such example, the system may be configured to identify an object of known dimension such as a clubhead or other object that the system uses to determine a scale of the hitting area. The system may be configured to recognize a particular object or type of object that the user is instructed to include in the field of view of the camera near the hitting area. In an example wherein a golf ball or similar is used, the ball may be used to scale the hitting area. The system may be configured to determine a surface orientation to orient the hitting area. For instance, the system may use points of body posture or body parts to inform orientation with respect to the hitting surface or otherwise. Example orientating points of reference may include an alignment obtained from detection of foot position, shoulder position at address, or an alignment that takes an average between the two. Additionally or alternatively, the user may be instructed to position an object orientated in the intended direction of shots from which the system detects within image frames and utilizes to calibrate orientation of the hitting surface. Further to the above, the system may be configured to identify and estimate the size of hitting area. This may be used for determination of divot dimensions and other divot variables. Additionally or alternatively, the system is configured to identify and estimate the size of the divot without estimating the size of the hitting area, e.g., using optically detectable markings on or near the hitting surface having known size, such as known length and width, optical markings having known spatial relationship, or using depth and camera view angle analysis. The system may additionally or alternatively use identification aspects of the hitting surface, e.g., boarders, optically detectable markings, or the like to determine directional orientation, e.g., for intended target direction. Size determination may include determining the angle of the hitting surface or divot with respect to the camera. In one example, determining the size of the hitting area, divot, or both may include using a depth perception algorithm or computer vision, for example. An image transformation with respect to the hitting surface may include projective registration or projective transformation, such as a homography transformation, of the hitting surface by, for example, projecting it onto a 2D plane. Additionally or alternatively, the divot may be binarized.

Extracting the data points from the image data 501 may include using the divot to identify image frames corresponding to points in the swing 504. This process may be performed using any suitable technique, such as any of those described herein, e.g., with respect to Examples 1 & 2 or elsewhere herein. In one embodiment, impact may be determined as the first frame in which the divot appears. In this or another embodiment, image frames corresponding to additional points may be identified using points of body posture, body posture variables, or motion or lack thereof with respect to tracking the same. The presence or absence of a divot may additionally be used in such identifications. For example, finish may begin at the first frame in which the divot ends and may begin and end at the last frame in which the hands, wrist, or club handle complete the swing arc or reach the highest position. This follow through finish may similarly be determined as the frame in which the hands, wrists, or club handle complete the swing arc or reach the highest position after the divot is fully formed.

Extracting the data points from the image data 501 may include predicting points of body posture and extracting raw data points by tracking the points during the swing to generate body posture variables raw data points from the divot to generate body posture variables during the swing 505. Extraction of raw data points to generate body posture variables may be performed using any suitable technique, such as any of those described herein, e.g., with respect to Examples 1 & 2 or elsewhere. For example, the system may utilize algorithms to track body posture changes like changes in knee bend, shoulder rotation, velocity and acceleration of wrists, moving weight from one foot to another, elbow bend changes, or the like. In this or another example, points of body posture may be predicted, which may include inferred, from a video model. In any of the above or another example, points of body posture may be predicted, which may include inferred, at every frame. Various points of body posture may be used as desired for generating the most accurate predictions such as knees, elbows, shoulders, wrists, hips, feet, eyes, nose, head, or other points, such as those described herein, including combinations thereof. Extracting the data points from the image data 501 may include identifying clubhead position and angle during swing 506. The system may be configured to employ various body posture models such as image pose estimation, human tracking, video pose estimation, or 3D uplifting models for depth estimation to generate a plurality of body posture variables from image data captured of a swing. Identification of clubhead position, angle, or both may be performed using any suitable technique, such as any of those described herein, e.g., with respect to Examples 1 & 2 or elsewhere. In one embodiment, identifying clubhead position and angle include identify clubhead position and angle relative to the camera at one or more points in the swing. In some embodiments, the method may include generating motion data with respect to the hitting surface, which may be accomplished in a manner similar to that described herein.

Extracting the data points from the image data 501 may include generating non-final predictions for shot variables using the extracted data points or variables 507. Generating non-final predictions for shot variables may be performed using any suitable technique, such as any of those described herein, e.g., with respect to Examples 1 & 2 or elsewhere. Predicted non-final shot variables may include club variables or other non-distance variables such as apex height, club path, club face angle, club direction, club speed, among others. In one application, distance shot variables such as carry distance, deviation distance, total distance, or combination thereof may be predicted. In an above or another configuration, the system may employ a multi-regression model that acts as a multi-modal network and takes both binarized divot image data and some raw data collected above appended in some of the post-CNN layers. For instance, the system may execute ball flight predictions in a large model architecture, which may include the above image data processing, with multimodal input vectors coming in at different starting points. The model may include a convolutional neural network (CNN).

The method 500 may include data processing and inference 508. In some embodiments, the data processing may include one or more of feature size reduction, pre-processing such as hot encoding, standardization, or normalization of variables. According to various embodiments, data processing an inference 508 may utilize model ensembles, such as sequential ensemble of models. Data processing and inference 508 may include generating final predicted non-distance shot variables 509. Final predicted non-distance shot variables may be predicted using any suitable technique, such as any of those described herein, e.g., with respect to Examples 1 & 2 or elsewhere. In one example, the predictions employ models that take as input certain club speed related variables like wrist velocities, club angles, and club head positions and non-final variables such as apex height, club path, club face angle, club direction, launch angle, club speed, non-final distance variables, or the like to predict an enhanced non-final club speed. In this or another example, the system may generate final variable predictions for apex, launch angle, direction, club speed, ball spin, ball speed, smash factor, and similar. In one example, multiple standalone XGB models may be utilized to generate the predictions. In one example, a combination of the above variables may be used to predict non-final carry distance, total distance, and deviation distance. This may utilize a suitable model, such as a model ensemble. In one application, multiple predictions from each model in the ensemble may be output.

Data processing and inference 508 may include generating final predicted distance shot variables 510. Final predicted distance shot variables may be predicted using any suitable modeling technique, such as any of those described herein, e.g., with respect to Examples 1 & 2 or elsewhere. In one example, the system is configured to predict final distance shot variables using a final model in an ensemble that receives as input the above outputs, which may correspond to the ensemble outputs, to output final distance predictions such as carry distance, deviation distance, and total distance.

Data processing and inference 508 may include generating predicted ball flight using final shot variables 511. Predicted ball flight may be predicted using any suitable modeling technique, such as any of those described herein, e.g., with respect to Examples 1 & 2 or elsewhere. In one implementation, the final shot variables may be combined to define a flight path, e.g., using launch angle, apex height, carry distance, deviation distance, and total carry distance. Additional shot variables may additionally or optionally be included such as categorical shot variables descriptive of a shot shape such as slice, fade, draw, hook, or the like.

Figure 6:
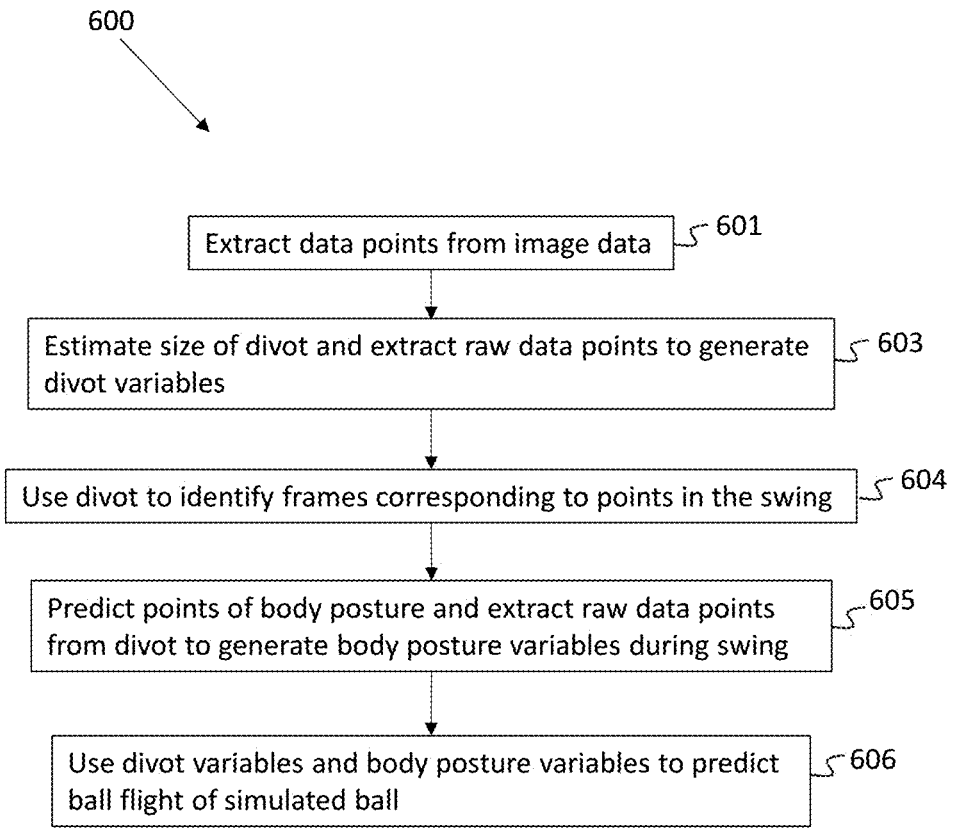
FIG. 6 illustrates a method of predicting a ball flight path from image data captured of a swing including a divot according to various embodiments describe herein.

FIG. 6 illustrates a method 600 of predicting ball flight utilizing image data of a golf swing that does not require a ball. The method 600 may include extracting data points from image data 601. Data points may be extracted from the image data using any suitable technique, such as any of those described herein, e.g., with respect to Examples 1 & 2, FIG. 5, or elsewhere. The method 600 may also include estimating size of the divot and extracting raw data points to generate divot variables 603. Divot size may be estimated and raw data points may be extracted to generate divot variables using any suitable technique, such as any of those described herein, e.g., as described with respect to step 502 of method 500. The divot may be used to identify frames corresponding to one or more points in the swing 604, which may be executed in a manner similar to that described with respect to step 504 of method 500.

The method 600 may include predicting points of body posture and extracting raw data points from the divot to generate body posture variables during the swing 605, which may be executed in a manner similar to that described with respect to step 505 of method 500.

The divot variables and body posture variables may be used to predict ball flight of a simulated ball 606. Use of variables to predict ball flight may be performed using any suitable modeling technique, such as any of those described herein, e.g., with respect to Examples 1 & 2, FIG. 5, or elsewhere. For example, multi-regression models, model ensembles, or other suitable models may be trained to take the data points, variables, or combination thereof as input to output shot variable predictions for apex, launch angle, direction, club speed, ball spin, carry distance, total distance, deviation distance, as examples, from which a ball flight path may be generated.

Figure 7:
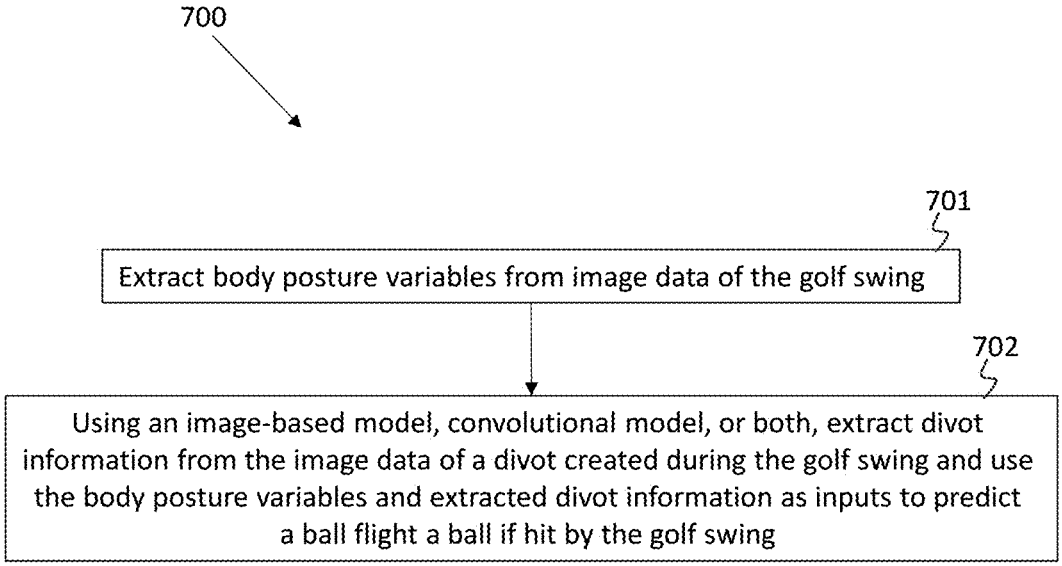
FIG. 7 illustrates a method of predicting a ball flight path from image data captured of a swing including a divot according to various embodiments describe herein.

FIG. 7 illustrates a method 700 of predicting ball flight utilizing image data of a golf swing that does not require a ball. The method may include extracting body posture variables from the image data of the golf swing 701. Body posture variables may be extracted using any suitable technique, such as any of those described herein, e.g., with respect to Examples 1 & 2, FIGS. 5 & 6, or elsewhere, such as step 505 of method 500. The method may further include using an image-based model, convolutional model, or both, extract divot information from image data of a divot created during a golf swing and use the body posture variables and extracted divot information as inputs to predict a ball flight a ball if hit by the golf swing 702. Examples using image-based models, convolutional models, and both to predict ball flight including extraction of divot information and use of body posture variables and extracted divot information are described herein, e.g., with respect to Examples 1 & 2, FIGS. 5 & 6, and elsewhere.

Figure 8:
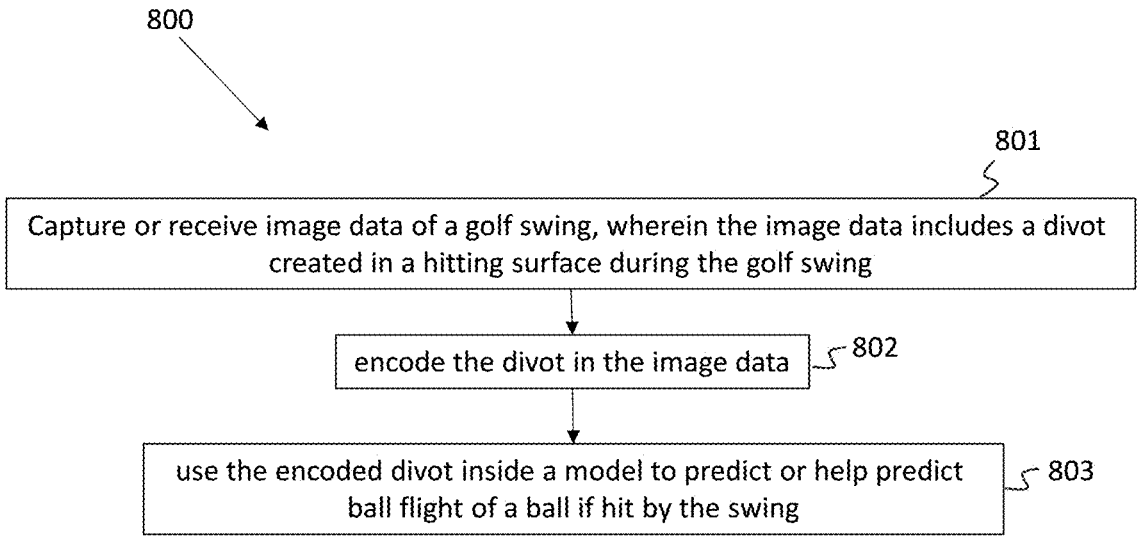
FIG. 8 illustrates a method of predicting a ball flight path from image data captured of a swing including a divot according to various embodiments describe herein.

FIG. 8 illustrates a method 800 of predicting ball flight utilizing image data of a golf swing that does not require a ball. The method includes capturing or receive image data of a golf swing, wherein the image data includes a divot created in a hitting surface during the golf swing 801. The method further includes encoding the divot in the image data 802. Divot data may be encoded using any suitable technique, such as any of those described herein, e.g., with respect to Examples 1 & 2, FIGS. 5-7, or elsewhere. For example, predicted shot variables may be generated by an image-based or convolutional model capable of extracting information from a divot. Divots may be processed, which may include binarized, as described herein. The method further includes using the encoded divot inside a model to predict or help predict ball flight of a ball if hit by the swing 803. Use of encoded divot data for ball flight predictions may be performed using any suitable technique, such as any of those described herein, e.g., with respect to Examples 1 & 2, FIGS. 5-7, or elsewhere.

Figure 9:
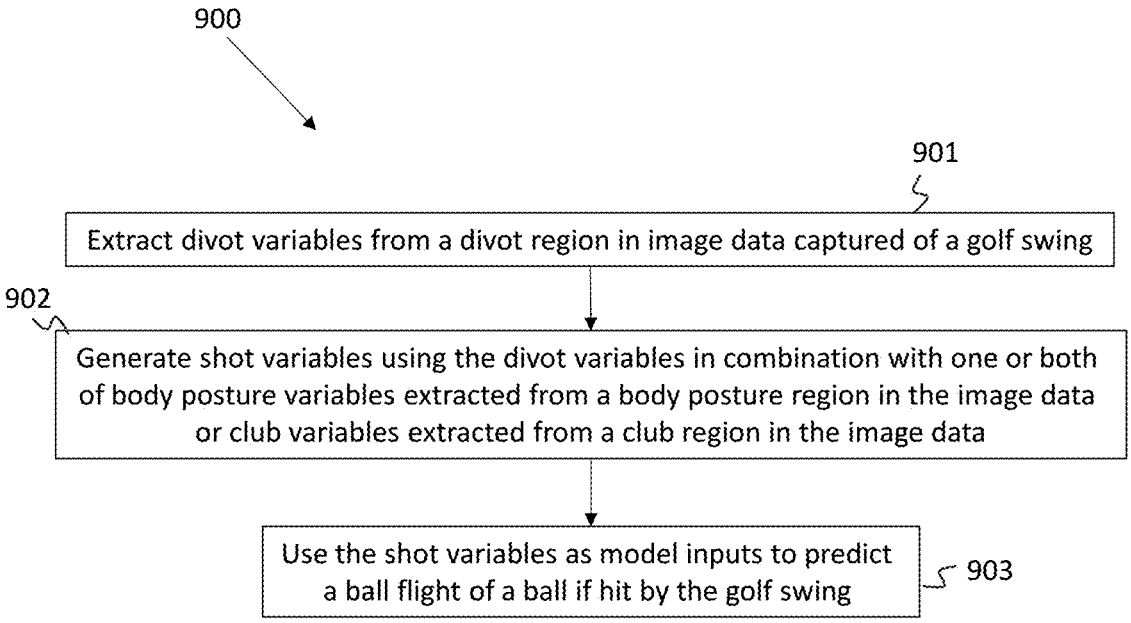
FIG. 9 illustrates a method of predicting a ball flight path from image data captured of a swing including a divot according to various embodiments describe herein.
Figure 10:
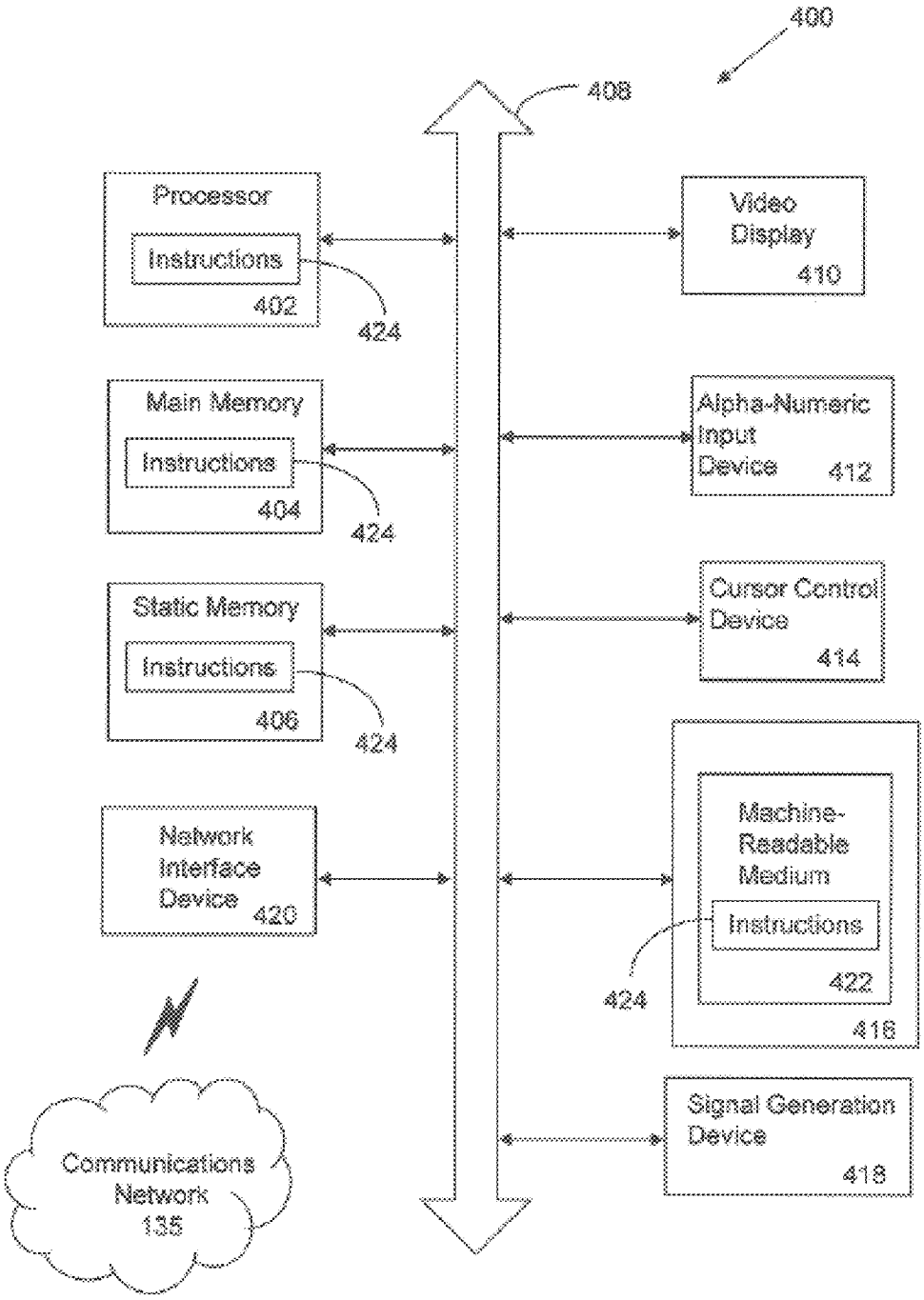
FIG. 10 schematically illustrates of a system according to various embodiments described herein.

FIG. 9 illustrates a method 900 of predicting ball flight utilizing image data of a golf swing that does not require a ball. The method includes extracting divot variables from a divot region in image data captured of a golf swing 901. The method further includes generating shot variables using the divot variables in combination with one or both of body posture variables extracted from a body posture region in the image data or club variables extracted from a club region in the image data 902. The method also includes using the shot variables as model inputs to predict a ball flight a ball if hit by the golf swing 903. Extracting divot variables from a divot region in image data captured of a golf swing 901, generating shot variables using the divot variables in combination with one or both of body posture variables extracted from a body posture region in the image data or club variables extracted from a club region in the image data 902, and using shot variables as model inputs to predict ball flight may be performed using any suitable modeling technique, such as any of those described herein, e.g., with respect to Examples 1 & 2, FIGS. 5-8, or elsewhere.

The system is not limited to the above and other variables described herein. For example, the system may be configured to output one or more categorical variables such as "low-pure shot" based on a combination of data points or other extracted variables that may be output for viewing by the user.

In one embodiment, the system is configured to implement an image-based or convolutional model configured to extract information from a divot. This information may comprise divot variables that the system utilizes together with body posture data, club identification data, or both to predict a ball flight of a simulated ball from a hitting surface. For example, the system may be configured to encode a divot in image data captured of a swing and use it inside of a model in order to predict or help predict or generate features for flight attributes.

In the above or another embodiment, the system is configured to employ body posture models such as image pose estimation, human tracking, video pose estimation, or 3D uplifting models for depth estimation to generate a plurality of body posture variables from image data captured of a swing. The system may be further configured to perform golf club identification and features associated with it to, for example, generate club related variables such as clubhead location, club path or direction, club face angle, and club speed for image data.

The system may be further configured to perform hitting surface identification from the image data including divot analysis to generate divot variables. Using the above variables, the system may be configured to generate a predicted ball flight of a simulated ball. This process may be performed despite the absence of a ball. The predicted ball flight may include predicted distance shot variables as well as non-distance shot variables, such as those described herein. Further to any of the above, the hitting surface may include a mat and the system may be configured to analyze the mat image captured during the swing to identify motion, such as momentary distortions, shrinkage, or compression or movement of the position of the mat on a ground surface as a result of the swing. In such an example, the system may be configured to utilize the motion data in modeling to predict shot variables use to generate predicted flight path.

In any of the above examples or another example, the system is configured to further utilize historical user data, such as the user height, skill level, target distance, accuracy of an N number of previous shots to predict shot variables.

In any of the above, predicted flight paths may include coordinates depicting the flight path or may be transformed into coordinates for rendering within a simulated shot environment, such as an animated environment depicting a golf course, range, target objects, or otherwise. The model outputs, such as shot variables, may be used to provide info to the user and for generation graphics consistent with the outputs. For example, a display of shot variables, which may include non-distance variables, distance variables, or combinations thereof may be displayed or available for selective display via user interaction with the user interface. In one example, available variables for display may include divot variables, body posture variables, or both. Body posture variables, for instance, may be additionally or alternatively available for view via a graphic rendering of the body posture. The values for the body posture variables may be incorporated in the graphic rendering or presented separately.

The predicted ball flight outputs described herein, such as with respect to Examples 1 & 2, and FIGS. 5-9 may include coordinates depicting ball flight path or may be transformed into coordinates for rendering within a simulated shot environment, such as an animated environment depicting a golf course, range, target objects, or otherwise. The model outputs, such as shot variables, may be used to provide info to the user and for generation graphics consistent with the outputs. For example, a display of shot variables, which may include non-distance variables, distance variables, or combinations thereof may be displayed or available for selective display via user interaction with the user interface. In one example, available variables for display may include divot variables, body posture variables, or both. Body posture variables, for instance, may be additionally or alternatively available for view via a graphic rendering of the body posture. The values for the body posture variables may be incorporated in the graphic rendering or presented separately. For instance, dynamic stick figure models may be generated as described herein. In another example, video to animation techniques may be used. In yet another example, avatars or animated body models may be used wherein the body posture variable coordinates are transformed if necessary and imported into a dynamic animation to define movement of the animated body model or avatar. In one example, the system includes or incorporates operations of a rendering engine to render the graphical depictions of a swing, ball flight, or both.

Any of the embodiments described herein may include output of body posture variables such as arm angles, wrist bend, wrist velocity, wrist acceleration, hip turn, shoulder turn, elbow bend, knee bend, spacing between elbows, spacing between elbows, spacing between wrist or hands and shoulder (e.g., hand path depth), arm to chest angle, clubhead speed at different points of the swing, among others to users via the user interface of the user device. In some examples, the values of body posture variables may be graphically depicted in a display in text. The values may be available for selective display. In these or other examples, the values for the body posture variables may be integrated in a dynamic animation of the swing, e.g., stick model, avatar, animated body model, wherein one or more of the values are displayed or selectively next to the animation. In a similar example, the system may be configured to integrate one or more of the values next to or overlaid onto the video image data or other video image data of the swing. In one configuration of the above examples, the values, manner of integration, or combination thereof may be selectable by the user via interaction with the user interface. The values may be provided numerically, color coding, or other visual indication. The values may be displayed or available for display at one or more points in the swing or throughout the swing. In one example, values such as wrist bend, elbow bend, arm to chest angle, spacing between wrist or hands to shoulder may be displayed over a swing depiction, animated model, video, or otherwise. Angle lines may be used to visually depicted angles with or without numerical values and be positioned over corresponding body posture points or adjacent to the swing depiction. Measurement bars scaled to the image to reflect distance values may similarly displayed with or without numerical values. In any of the above or another example, body posture variables, which may include other data extracted therefrom for use in operations other than prediction of ball flight, include timing of body posture variables, related body motion, or both with respect to swing stage or other body posture variables. For instance, relationships between hip turn, shoulder turn, club parallel, top of backswing, head position at points in swing, wrist velocities at points in swing, hand path depth at points in swing, among others may be tracked and available for display. These relationships may be used by the models to predict ball flight, used for training or information purposes, or combination thereof. The relationships may be further analyzed temporally for sequencing analysis or training. In one embodiment, one or more of the body posture variables may be input into a model trained for swing analysis to output swing tips or other recommendations to improve swings. The above processing and presentation can be invaluable to users for purposes of information or teaching purposes. However, before now, such information was unavailable to typical golfers and generally unobtainable without employing elaborate wearable sensor devices.

In various embodiments, the system may be configured to calibrate models to a user's swing using labeled past swing data of the user. The calibration may utilize ranker modeling trained on swings labeled with respect to variables, such as carry distance, deviation distance, or total distance. Other variables may include club speed or other shot variables such as those described herein. Ranker models may be trained for each target variable. The labels may be provided by the user or otherwise. The labeled swings may be processed to compare results with the labels, such as user produced labels. Subsequent swings may be processed by running the swing data extracted from the image data of the subsequent swing using a ranker algorithm to order swings via a target variable. The output rank may then be used as input in another model to produce an enhanced prediction for the target variable. This process may be repeated for other variables.

In one example, a number of swings may be labeled. For instance a user may label any amount of swings over their time utilizing the system. The system may process all the user's swings on servers or otherwise to compare results with the user produced labels. For each subsequent swing the user requests a prediction, the system may employ a ranker algorithm. The ranker algorithm may be similar to XGB or LGB boosted rankers, for instance. The ranker algorithm may order the swings via a target variable. In one example use case, a user has labeled 20 swings and the system has trained a ranker model on the labels. The ranker model for each target variable is configured to output an ordering, e.g., swing 7 is ranked number 1, swing 18 is ranked number 2, etc. Each ranker model is configured to be responsible for one target variable, so the ordering of swings for one variable would not necessarily be the order for another variable, e.g., swing order in a carry distance ranker model would likely be different from the swing order in a carry deviation ranker model including the same set of swings. Therefore, if swing 7 is ranked number 1 in the target variable carry distance, then of all the labeled swings, swing 7 has highest carry distance. When the user takes a new swing and requests a prediction for this unlabeled swing, the system may input the swing data for this new along with the swing data for the labeled swings inside of each ranker and get a result. For example, if the new swing ranked number 2 in the carry distance target variable category, the new swing is predicted from the ranking to have the number 2 highest carry distance if included in the set of 20 labeled swings. Looking to the labeled carry distances, the number 1 ranked swing in carry distance may have been 170 yards and number 3 ranked swing in carry distance, number 2 in the labeled swing set, may have been 160 yards. From this, the carry distance of the new swing is predicted to be between 160 and 170 yards. This may be used as input to generate an enhanced prediction for the target variable, carry distance. This process may be repeated for other variables. In one example, the rank value or value interval may be used as input into the previously generated tabular models, such as those described herein.

The techniques described herein are non-limiting and are provided as an example. As noted above, those having skill in the art will appreciate upon reading the present disclosure that there exists many potential modifications to the above techniques as well as different techniques to predict ball flight path. Such modifications and different techniques are contemplated and are to be considered disclosed herein as within the scope of the invention.

While the embodiments described herein generally include analysis of a divot region, it is to be appreciated that in various embodiments analysis of a divot region may be excluded and shots without a ball may be simulated as otherwise disclosed herein. Additionally or alternatively, various embodiments may include a ball. In one such embodiment, the system is configured to simulate shots as described above, e.g., without analysis of the ball trajectory after impact. In one example, the ball may be used as a ball mark indicator. In another embodiment, the system may be configured to combine analysis of the ball trajectory, initial launch or thereafter, as is known in the art with the methodologies described herein to provide even greater simulation and shot analysis capabilities.

In certain embodiments, any device in the system 100 may transmit a signal to a memory device to cause the memory device to only dedicate a selected amount of memory resources to the various operations of the system 100. In certain embodiments, the system 100 and methods may also include transmitting signals to processors and memories to only perform the operative functions of the system 100 and methods at time periods when usage of processing resources and/or memory resources in the system 100 is at a selected and/or threshold value. In certain embodiments, the system 100 and methods may include transmitting signals to the memory devices utilized in the system 100, which indicate which specific portions (e.g. memory sectors, etc.) of the memory should be utilized to store any of the data utilized or generated by the system 100. Notably, the signals transmitted to the processors and memories may be utilized to optimize the usage of computing resources while executing the operations conducted by the system 100. As a result, such features provide substantial operational efficiencies and improvements over existing technologies.

Referring now also to FIG. 5, at least a portion of the methodologies and techniques described with respect to the exemplary embodiments of the system 100 can incorporate a machine, such as, but not limited to, computer system 400, or other computing device within which a set of instructions, when executed, may cause the machine to perform any one or more of the methodologies or functions discussed above. The machine may be configured to facilitate various operations conducted by the system 100. For example, the machine may be configured to, but is not limited to, assist the system 100 by providing processing power to assist with processing loads experienced in the system 100, by providing storage capacity for storing instructions or data traversing the system 100, or by assisting with any other operations conducted by or within the system 100.

In some embodiments, the machine may operate as a standalone device. In some embodiments, the machine may be connected (e.g., using a communications network 135, another network, or a combination thereof) to and assist with operations performed by other machines and systems, such as, but not limited to, the camera 102, processor 104, server 150, graphical display 106, database 107, user device 108, or any combination thereof. The machine may be connected with any component in the system 100. In a networked deployment, the machine may operate in the capacity of a server or a client user machine in a server-client user network environment, or as a peer machine in a peer-to-peer (or distributed) network environment. The machine may comprise a server computer, a client user computer, a personal computer (PC), a tablet PC, a laptop computer, a desktop computer, a control system, a network router, switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The computer system 400 may include a processor 402 (e.g., a central processing unit (CPU), a graphics processing unit (GPU, or both), a main memory 404 and a static memory 406, which communicate with each other via a bus 408. The computer system 400 may further include a video display unit 410, which may be, but is not limited to, a liquid crystal display (LCD), a flat panel, a solid state display, or a cathode ray tube (CRT). The computer system 400 may include an input device 412, such as, but not limited to, a keyboard, a cursor control device 414, such as, but not limited to, a mouse, a disk drive unit 416, a signal generation device 418, such as, but not limited to, a speaker or remote control, and a network interface device 420.

The disk drive unit 416 may include a machine-readable medium 422 on which is stored one or more sets of instructions 424, such as, but not limited to, software embodying any one or more of the methodologies or functions described herein, including those methods illustrated above. The instructions 424 may also reside, completely or at least partially, within the main memory 404, the static memory 406, or within the processor 402, or a combination thereof, during execution thereof by the computer system 400. The main memory 404 and the processor 402 also may constitute machine-readable media.

Dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example system is applicable to software, firmware, and hardware implementations.

In accordance with various embodiments of the present disclosure, the methods described herein are intended for operation as software programs running on a computer processor. Furthermore, software implementations can include, but not limited to, distributed processing or component/object distributed processing, parallel processing, or virtual machine processing can also be constructed to implement the methods described herein.

The present disclosure contemplates a machine-readable medium 422 containing instructions 424 so that a device connected to the communications network 135, another network, or a combination thereof, can send or receive voice, video or data, and communicate over the communications network 135, another network, or a combination thereof, using the instructions. The instructions 424 may further be transmitted or received over the communications network 135, another network, or a combination thereof, via the network interface device 420.

While the machine-readable medium 422 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that causes the machine to perform any one or more of the methodologies of the present disclosure.

The terms "machine-readable medium," "machine-readable device," or "computer-readable device" shall accordingly be taken to include, but not be limited to: memory devices, solid-state memories such as a memory card or other package that houses one or more read-only (non-volatile) memories, random access memories, or other re-writable (volatile) memories; magneto-optical or optical medium such as a disk or tape; or other self-contained information archive or set of archives is considered a distribution medium equivalent to a tangible storage medium. The "machine-readable medium," "machine-readable device," or "computer-readable device" may be non-transitory, and, in certain embodiments, may not include a wave or signal per se. Accordingly, the disclosure is considered to include any one or more of a machine-readable medium or a distribution medium, as listed herein and including art-recognized equivalents and successor media, in which the software implementations herein are stored.

The illustrations of arrangements described herein are intended to provide a general understanding of the structure of various embodiments, and they are not intended to serve as a complete description of all the elements and features of apparatus and systems that might make use of the structures described herein. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description. Therefore, it is intended that the disclosure not be limited to the particular arrangement(s) disclosed as the best mode contemplated for carrying out this invention, but that the invention will include all embodiments and arrangements falling within the scope of the appended claims.

The foregoing is provided for purposes of illustrating, explaining, and describing embodiments of this invention. Modifications and adaptations to these embodiments will be apparent to those skilled in the art and may be made without departing from the scope or spirit of this invention. Upon reviewing the aforementioned embodiments, it would be evident to an artisan with ordinary skill in the art that said embodiments can be modified, reduced, or enhanced without departing from the scope and spirit of the claims described below.

What is claimed is:

1. A method of predicting ball flight of a golf ball, the method comprising:

analyzing image data captured of a golf swing taken by a subject, the image data including a divot in a hitting surface created by the golf swing to generate divot variables, the hitting surface including a ball location indicator;

generating a predicted ball flight of a simulated golf ball resulting from the golf swing if positioned at the ball location indictor, wherein the generated predicted ball flight is at least partly based on the divot variables generated from the analysis of the image data of the divot region.

2. The method of claim 1, wherein generating the predicted ball flight does not include analysis of movement of an actual golf ball hit from the hitting surface during the golf swing, if present.

3. The method of claim 2, wherein the analysis of the image data further comprises analyzing a body posture region of the subject during the golf swing to generate body posture variables, and wherein generating the predicted ball flight is also at least partly based on the body posture variables.

4. The method of claim 3, wherein the analysis of the body posture region includes extracting data points of body posture, and wherein the method further includes outputting the data points of body posture for generation of an animated representation of the body posture of the subject during the golf swing.

5. The method of claim 2, wherein the method further comprising analyzing image data of a clubhead region during the golf swing, and wherein the predicting is based at least partly on the analysis of the image data of the clubhead region.

6. The method of claim 3, wherein the image data of the golf swing is captured by a smart phone or tablet camera.

7. The method of claim 6, further comprising processing the ball flight data for rendering a graphical representation of the ball flight within an animated environment.

8. A system comprising:

a processor;

a memory storing instructions that when executed by the processor cause the system to perform the operations comprising:

capturing or receiving image data of a golf swing, wherein the image data includes a divot created in a hitting surface during the golf swing;

extracting divot variables from a divot region in image data captured of a golf swing;

generating shot variables using the divot variables in combination with one or both of body posture variables extracted from a body posture region in the image data or club variables extracted from a club region in the image data; and using the shot variables as model inputs to generate predicted ball flight data representative of a predicted ball flight of a ball if hit by the golf swing, wherein the system is configured to predict the ball flight without analysis of movement of an actual golf ball hit from the hitting surface during the golf swing, if present.

9. The system of claim 8, wherein the operation of extracting the divot variables includes encoding the divot included in the image data.

10. The system of claim 9, wherein the operation of extracting the divot variables further includes using the encoded divot inside a model to predict or help predict the ball flight.

11. The system of claim 9, wherein the operation of extracting the divot variables includes utilizing an image-based or convolutional model to extract information from the divot included in the image data.

12. The system of claim 9, wherein the operations further comprise extracting body posture variables from the body posture region in the image data.

13. The system of claim 12, wherein the operation of extracting body posture variables from the body posture region in the image data comprises utilizing one or more body posture models selected from image pose estimation models, human tracking models, video pose estimation models, or 3D uplifting models for depth estimation.

14. The system of claim 8, wherein the image data of the golf swing was captured by a smart phone or tablet camera.

15. The system of claim 14, wherein the operations further comprise processing the ball flight data for rendering a graphical representation of the ball flight within an animated environment.

16. A non-transitory computer readable medium storing instructions that when executed by a processor causes a machine to performs the method of claim 1.

* * * * *